US012029965B2

(12) United States Patent
Vaillancourt et al.

(10) Patent No.: US 12,029,965 B2
(45) Date of Patent: Jul. 9, 2024

(54) HOCKEY GOALKEEPER LEG PADS

(71) Applicant: BAUER HOCKEY LTD., Blainville (CA)

(72) Inventors: Charles Vaillancourt, Blainville (CA); Mathieu Poitras, Saint-Jerome (CA)

(73) Assignee: BAUER HOCKEY LLC, Exeter, NH (US)

( * ) Notice: Subject to any disclaimer, the term of this patent is extended or adjusted under 35 U.S.C. 154(b) by 112 days.

(21) Appl. No.: 16/560,373

(22) Filed: Sep. 4, 2019

(65) Prior Publication Data

US 2020/0070035 A1 Mar. 5, 2020

Related U.S. Application Data

(60) Provisional application No. 62/726,683, filed on Sep. 4, 2018.

(51) Int. Cl.
*A63B 71/12* (2006.01)
*A41D 13/05* (2006.01)
(Continued)

(52) U.S. Cl.
CPC ..... *A63B 71/1225* (2013.01); *A41D 13/0543* (2013.01); *A41D 13/065* (2013.01);
(Continued)

(58) Field of Classification Search
CPC ..... A41D 13/0543; A41D 13/065; A41D 2600/10; A63B 71/1225; A63B 2071/1241; A63B 2071/1258; A63B 2071/1266; A63B 2071/1275; A63B 2071/1283; A63B 2071/125; A63B 2102/24; A63B 2102/22; A63B 2209/10; A63B 2209/00; A63B 2225/09; A63B 2225/096; A61F 5/085; A61F 5/0123; A61F 5/0127; A61F 5/0135; A61F 5/0106; A61F 5/0111; A61F 5/0118
(Continued)

(56) References Cited

U.S. PATENT DOCUMENTS 2,785,407 A * 3/1957 Reeder ..... A63B 71/08 2/22
3,877,077 A 4/1975 Chapdelaine
(Continued)

FOREIGN PATENT DOCUMENTS

CA 3043833 11/2022

OTHER PUBLICATIONS

Examiner's Report dated Jun. 8, 2020 in connection with Canadian Patent Application No. 3,043,833, 4 pages.
(Continued)

*Primary Examiner* — Katherine M Moran
*Assistant Examiner* — Haley A Smith

(57) ABSTRACT

Hockey goalkeeper leg pads wearable on legs of a hockey goalkeeper to protect the legs, in which the hockey goalkeeper leg pads may be configured to enhance performance, comfort and/or other aspects of goalkeeping of the hockey goalkeeper, including when the hockey goalkeeper leg pads drop onto a playing surface (e.g., ice) to lie substantially horizontally on the playing surface with their front facing play (e.g., as in a "butterfly" position or otherwise).

43 Claims, 41 Drawing Sheets

(51) Int. Cl.
*A41D 13/06* (2006.01)
*A63B 102/22* (2015.01)
*A63B 102/24* (2015.01)

(52) U.S. Cl.
CPC .. *A41D 2600/10* (2013.01); *A63B 2071/1241* (2013.01); *A63B 2071/125* (2013.01); *A63B 2071/1258* (2013.01); *A63B 2071/1266* (2013.01); *A63B 2071/1275* (2013.01); *A63B 2071/1283* (2013.01); *A63B 2102/22* (2015.10); *A63B 2102/24* (2015.10); *A63B 2209/00* (2013.01); *A63B 2209/10* (2013.01)

(58) Field of Classification Search
USPC ..... 2/22
See application file for complete search history.

(56) References Cited

U.S. PATENT DOCUMENTS 4,136,226 A * 1/1979 Gilman ..... B60R 21/04 428/215
4,868,926 A * 9/1989 Lowson ..... A63B 71/1225 2/22
4,980,110 A * 12/1990 Nelson ..... B29C 65/70 264/273
5,093,931 A * 3/1992 LaBerge ..... A63B 71/1225 2/22
5,172,425 A 12/1992 Smith
5,273,702 A * 12/1993 Nelson ..... B29C 70/70 264/153
5,361,410 A * 11/1994 Sigl ..... A63B 71/08 2/904
5,452,475 A 9/1995 Hunt
5,617,580 A * 4/1997 DiCesare ..... A63B 71/1225 2/22
D396,134 S 7/1998 Shikatani
5,784,715 A 7/1998 Buchanan
5,806,092 A 9/1998 Shikatani
6,282,724 B1 * 9/2001 Abraham ..... A41D 13/015 2/455
D455,871 S 4/2002 Di Biase
6,468,239 B1 * 10/2002 Mollura, Sr. ..... A61F 5/0111 128/882
6,560,781 B1 5/2003 Keene et al.
6,964,062 B1 11/2005 Chen
D554,295 S 10/2007 Darche
D554,296 S 10/2007 Darche
8,261,369 B2 9/2012 Sioui et al.
D674,149 S 1/2013 Smith
D683,907 S 6/2013 Smith
9,440,136 B2 9/2016 Smith
9,861,152 B1 * 1/2018 Rumfelt ..... A63B 71/12
10,391,686 B2 * 8/2019 Kuroki ..... B29C 44/1209
11,623,130 B2 4/2023 Vaillancourt
2002/0162153 A1 11/2002 Collins et al.
2005/0015841 A1 * 1/2005 Hoffman ..... A41D 13/05 2/22
2005/0071906 A1 4/2005 Infante
2006/0026732 A1 * 2/2006 Nordt, III ..... A61F 5/0106 2/69
2007/0050876 A1 3/2007 Whitmire
2007/0180594 A1 8/2007 Ashby-Bey
2007/0214538 A1 9/2007 Castonguay et al.
2007/0250977 A1 11/2007 Brown et al.
2008/0078007 A1 * 4/2008 Lefebvre ..... A63B 71/1225 2/22
2008/0201814 A1 * 8/2008 Goyer ..... A41D 13/0543 2/22
2009/0025114 A1 * 1/2009 Hudon ..... A63B 71/1225 2/22
2009/0210990 A1 8/2009 Taylor
2010/0107291 A1 5/2010 Carter
2010/0138971 A1 6/2010 McVeigh et al.
2010/0192269 A1 8/2010 Saranga
2013/0025017 A1 1/2013 Chen
2013/0318675 A1 * 12/2013 Mackey ..... A63B 71/1225 2/22
2014/0082812 A1 3/2014 Keehu
2014/0259259 A1 * 9/2014 Smith ..... A63B 71/1225 2/22
2014/0259261 A1 * 9/2014 Mackey ..... A63B 69/0026 2/22
2015/0033433 A1 2/2015 Mackey et al.
2015/0106991 A1 4/2015 Gouniot
2015/0128325 A1 5/2015 Vaughn
2016/0038821 A1 * 2/2016 Mackey ..... A43B 5/1666 2/463
2016/0354672 A1 12/2016 Smith
2017/0055603 A1 3/2017 Guidetti et al.
2018/0292177 A1 10/2018 Roby et al.
2018/0326290 A1 11/2018 Rodrick et al.
2019/0011216 A1 * 1/2019 Carlston ..... F41B 5/1473
2019/0038956 A1 2/2019 Contant et al.
2019/0308086 A1 10/2019 Filiatrault-Giroux et al.
2019/0351311 A1 11/2019 Vaillancourt

OTHER PUBLICATIONS

Non-Final Office Action dated Dec. 2, 2020 in connection with U.S. Appl. No. 16/414,997, 27 pages.
Examiner's Report dated Dec. 30, 2020 in connection with Canadian Patent Application No. 3,043,833, 8 pages.
Final Office Action dated Jun. 16, 2021 in connection with U.S. Appl. No. 16/414,997, 26 pages.
Final Office Action dated Sep. 23, 2022 in connection with U.S. Appl. No. 16/414,997, 15 pages.
Non-Final Office Action dated Apr. 22, 2022 in connection with U.S. Appl. No. 16/414,997, 27 pages.
Notice of Allowance dated Dec. 7, 2022 in connection with U.S. Appl. No. 16/414,997, 6 pages.
Notice of Allowability dated Dec. 14, 2022 in connection with U.S. Appl. No. 16/414,997, 6 pages.
Notice of Allowability dated Dec. 14, 2022 in connection with U.S. Appl. No. 16/414,997, 3 pages.
Examiner's Report dated Dec. 30, 2022 in connection with Canadian Patent Application No. 3,054,415, 6 pages.
Examiner's Report dated Jul. 26, 2023 in connection with Canadian Patent Application No. 3,054,415, 4 pages.

* cited by examiner

HOCKEY GOALKEEPER LEG PADS

CROSS-REFERENCE TO RELATED APPLICATION

This application claims priority from U.S. Provisional Patent Application 62/726,683 filed on Sep. 4, 2018 and incorporated by reference herein.

FIELD

This disclosure relates generally to protective hockey equipment and, more particularly, to hockey goalkeeper leg pads for protecting legs of hockey goalkeepers.

BACKGROUND

Hockey goalkeepers (a.k.a. goalies) defend their team's goal in a hockey game, and, to that end, they wear various equipment, including leg pads to protect their legs against impacts from pucks, balls, hockey sticks or other objects and/or when moving (e.g., dropping) them onto a playing surface (e.g., ice).

A hockey goalkeeper leg pad, which is often referred to a "goalie pad", typically comprises a front body and side extensions that project rearwardly from its front body, such as medial and lateral knee extensions that define a knee cradle for a goalie's knee and medial and lateral calf extensions that define a lower leg channel for the goalie's lower leg. For instance, the medial side knee extension may engage the goalie's knee when the goalie pad drops onto a playing surface as the goalie drives his/her knee down and then presses it against the playing surface, such as in a "butterfly" position or otherwise.

While a goalie pad's side extensions are useful and have been improved over time, they may sometimes have issues that affect, for example, their stability or responsiveness. In some cases, this may be caused by how they are secured to a remainder of the goalie pad, such as by being sewn or laced in as tightly as possible.

For these and other reasons, improvements in hockey goalkeeper leg pads would be welcomed.

SUMMARY

According to various aspects, this disclosure relates to hockey goalkeeper leg pads wearable on legs of a hockey goalkeeper to protect the legs, in which the hockey goalkeeper leg pads may be configured to enhance performance, comfort and/or other aspects of goalkeeping of the hockey goalkeeper, including when the hockey goalkeeper leg pads drop onto a playing surface (e.g., ice) to lie substantially horizontally on the playing surface with their front facing play (e.g., as in a "butterfly" position or otherwise).

For example, according to one aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises: a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding. The front pad member and the side pad member are interconnected.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises a front portion configured to overlie a front of the hockey goalkeeper's leg and comprising a front pad member of the padding; and a medial side portion configured to overlie a medial side of the hockey goalkeeper's leg and comprising a medial side knee extension that projects rearwardly from the front portion and comprises a medial side knee pad member of the padding. The front pad member and the medial side knee pad member are interconnected.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises a covering that covers at least part of the padding. The hockey goalkeeper leg pad comprises a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding. The front pad member and the side pad member are connected to one another independently of a connection of the covering and the padding.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper led pad comprises a covering that covers at least part of the padding. The hockey goalkeeper leg pad comprises a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding. The front pad member and the side pad member are connected to one another inside the covering.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding. The hockey goalkeeper leg pad comprises a reinforcement disposed in the front portion and the side portion. The front portion comprises a front reinforcing member of the reinforcement. The front reinforcing member is adjacent to and stiffer than the front pad member. The side portion comprises a side reinforcing member of the reinforcement. The side reinforcing member is adjacent to and stiffer than the side pad member. The front reinforcing member and the side reinforcing member are interconnected.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises a front portion configured to overlie a front of the hockey goalkeeper's leg and comprising a front pad member of the padding; and a medial side portion configured to overlie a medial side of the hockey goalkeeper's leg and comprising: a medial side knee extension that projects rearwardly from the front portion and comprises a medial side knee pad member of the padding; and a medial side calf extension that projects rearwardly from the front portion and comprises a medial side calf pad member of the padding. The medial side calf extension is configured to bear loading from the lower leg region of the hockey goalkeeper when the medial side knee extension engages a playing surface.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises: a front portion configured to overlie a front of the hockey goalkeeper's leg and comprising a front pad member of the padding; a side portion configured to overlie a side of the hockey goalkeeper's leg and comprising a side extension that projects rearwardly from the front portion and comprises a side pad member of the padding. The side portion is rotatable relative to the front portion over a range of motion. The range of motion comprises a position of the side portion relative to the front portion wherein a resistance to rotate outwardly is different from a resistance to rotate inwardly.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises: a front portion configured to overlie a front of the hockey goalkeeper's leg and comprising a front pad member of the padding; a side portion configured to overlie a side of the hockey goalkeeper's leg and comprising a side extension that projects rearwardly from the front portion and comprises a side pad member of the padding. The side portion is rotatable relative to the front portion over a range of motion. The range of motion comprises a first position of the side portion relative to the front portion and a second position of the side portion relative to the front portion. A resistance of the side portion to rotate outwardly at the first position is different from a resistance of the side portion to rotate outwardly at the second position.

According to another aspect, this disclosure relates to a hockey goalkeeper leg pad wearable on a leg of a hockey goalkeeper to protect the leg. The hockey goalkeeper leg pad comprises an upper leg portion, a knee portion, a lower leg portion, and a foot portion respectively configured to protect an upper leg region, a knee, a lower leg region, and a foot of the hockey goalkeeper. The hockey goalkeeper leg pad comprises padding disposed in the upper leg portion, the knee portion, the lower leg portion, and the foot portion. The hockey goalkeeper leg pad comprises: a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding. The side portion is rotatable relative to the front portion over a range of motion. The range of motion comprises a position of the side portion relative to the front portion wherein a resistance to rotate outwardly is at least 5000 N·mm per degree.

These and other aspects of this disclosure will now become apparent upon review of a description of embodiments that follows in conjunction with accompanying drawings.

BRIEF DESCRIPTION OF DRAWINGS

A detailed description of embodiments is provided below, by way of example only, with reference to accompanying drawings, in which.

The description and drawings are only for purposes of illustrating certain embodiments and are an aid for understanding. They are not intended to be limiting.

DETAILED DESCRIPTION OF EMBODIMENTS

Figure 1:
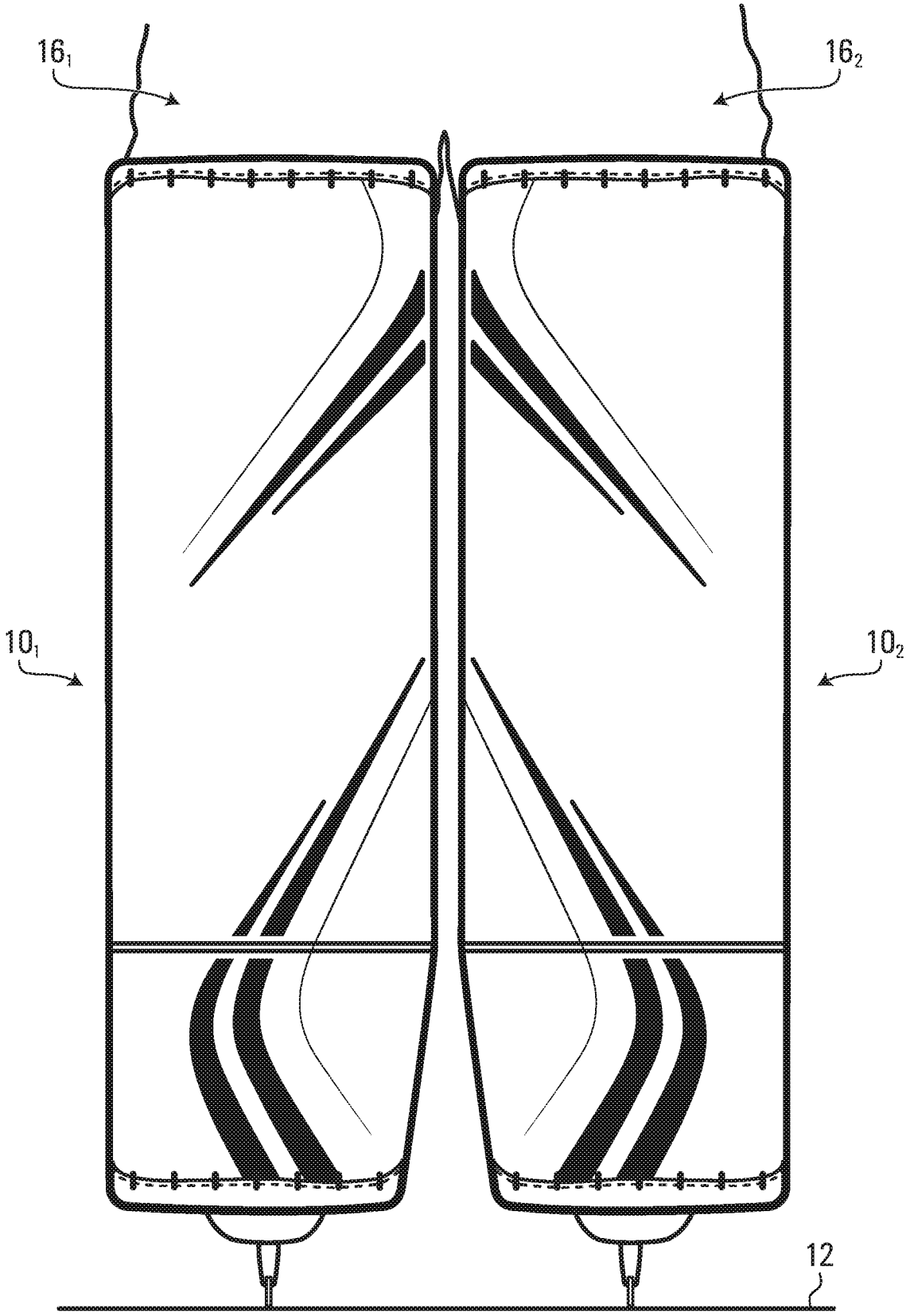
FIG. 1 shows a front view of an embodiment of hockey goalkeeper leg pads for protecting legs of a hockey goalkeeper.
Figure 2:
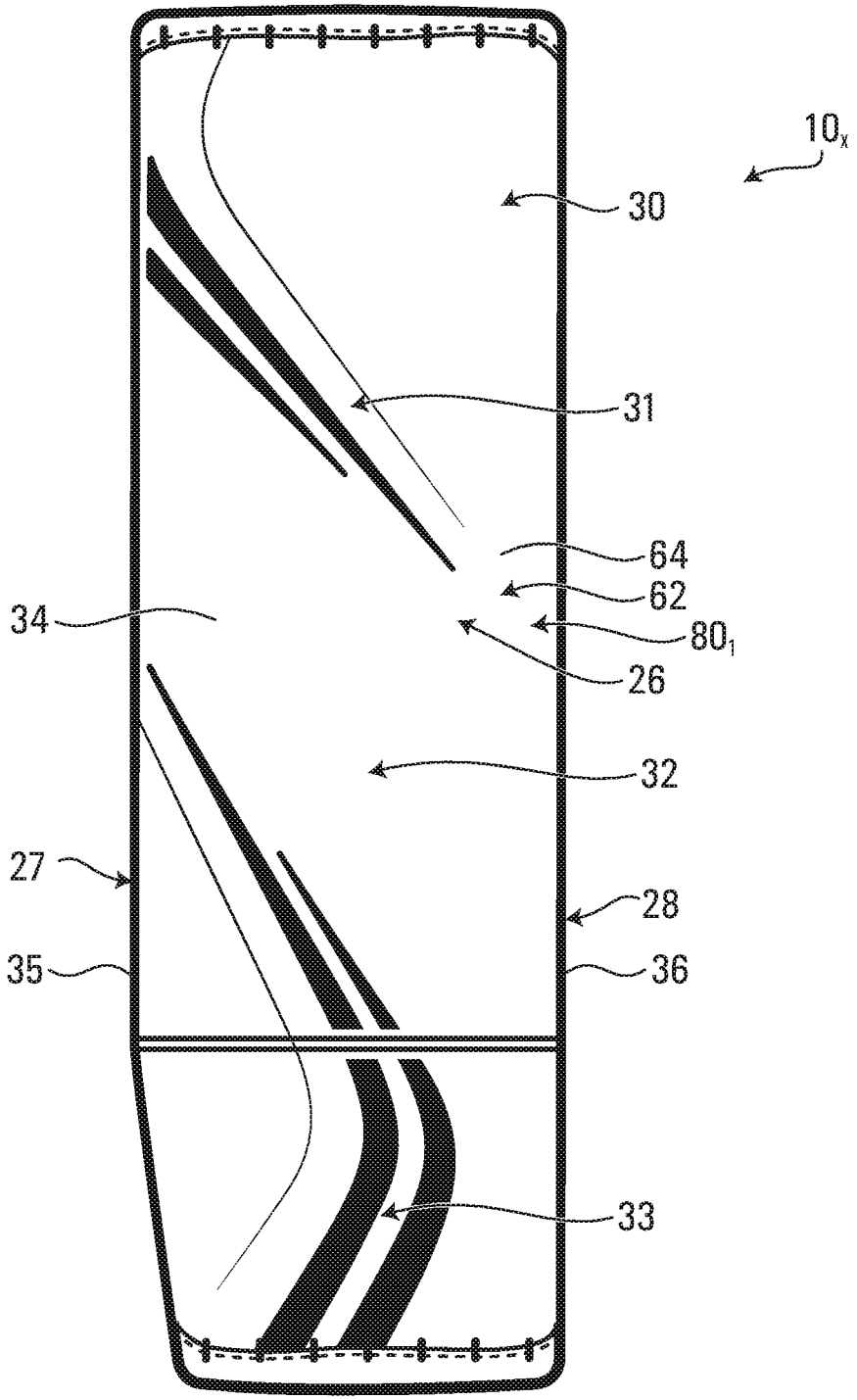
FIG. 2 shows a front view of a given one of the leg pads.
Figure 3:
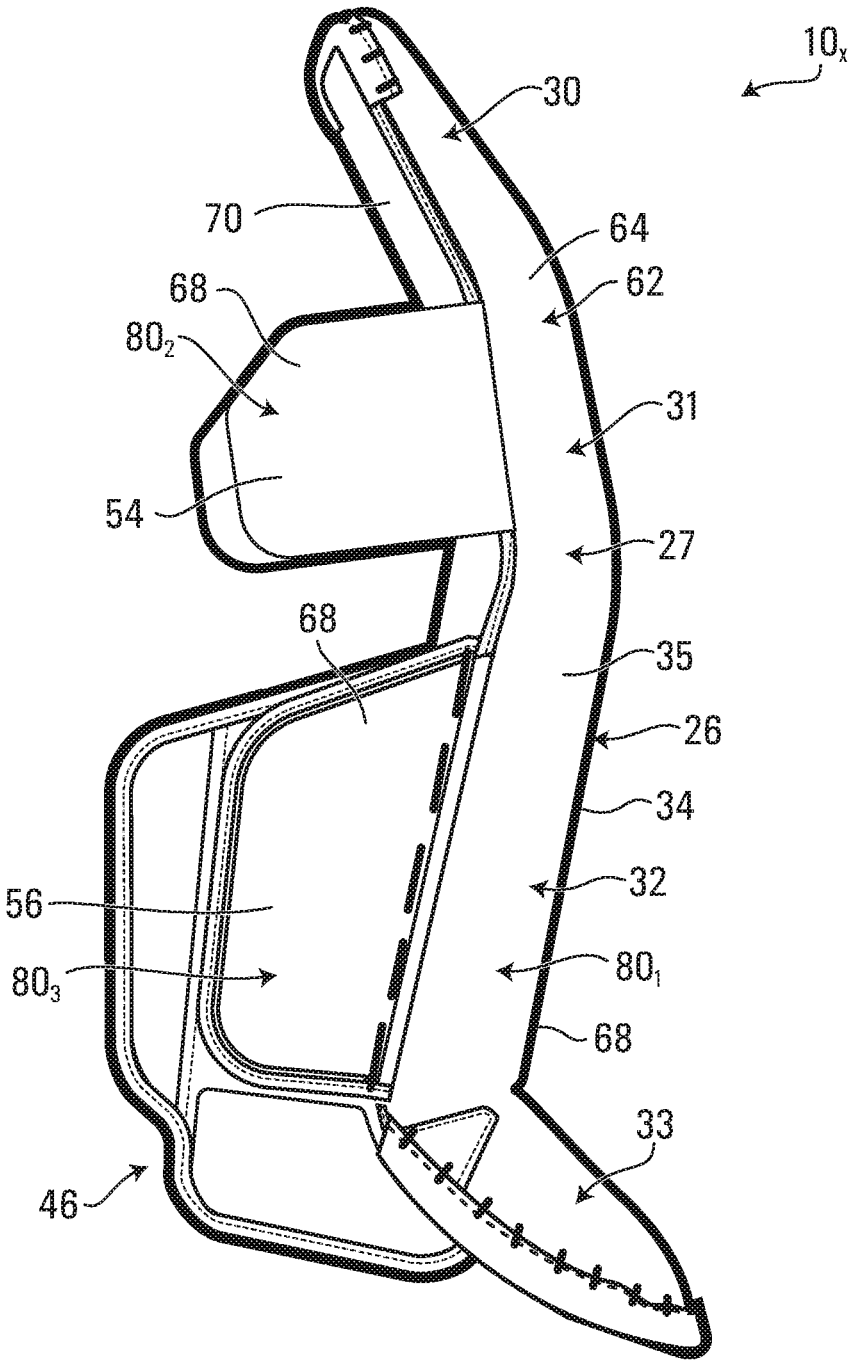
FIG. 3 shows a medial side view of the leg pad.
Figure 4:
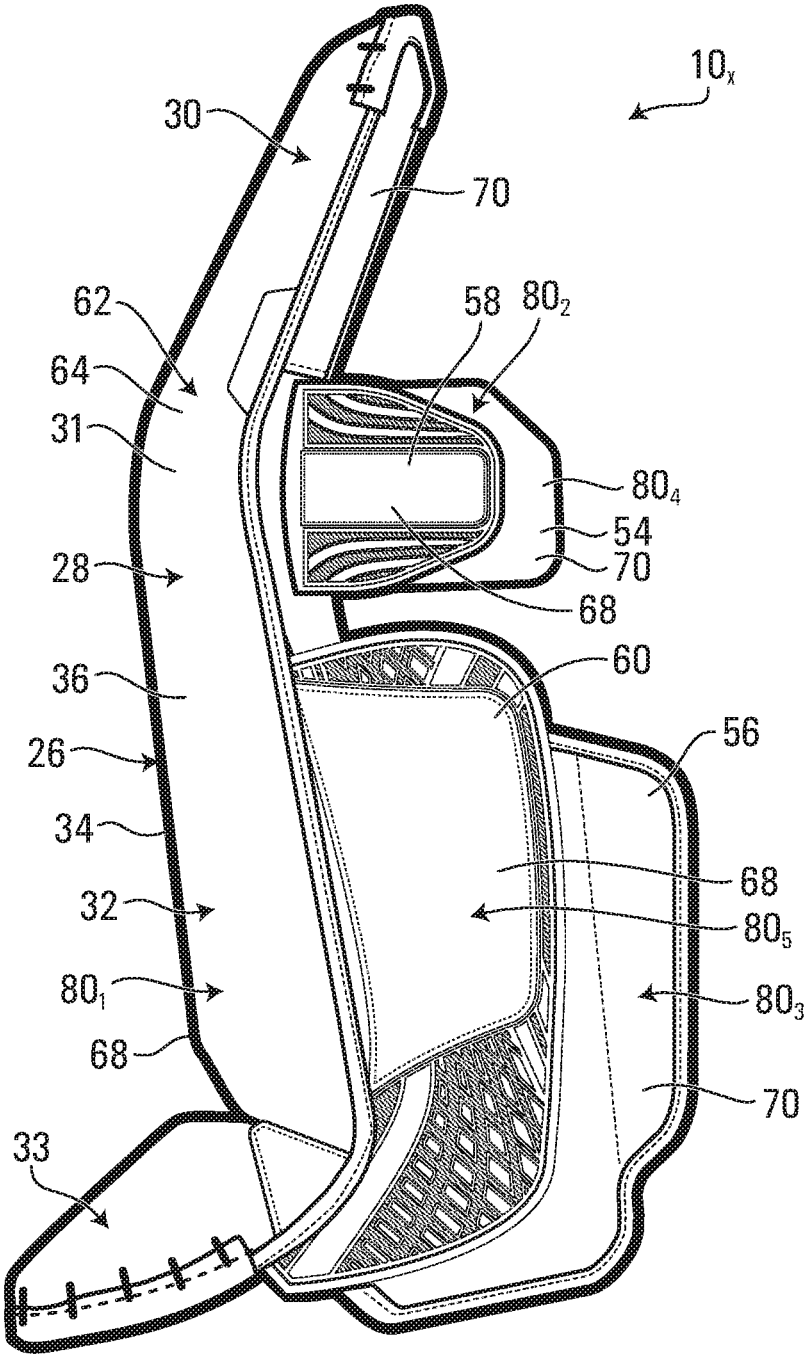
FIG. 4 shows a lateral side view of the leg pad.
Figure 5:
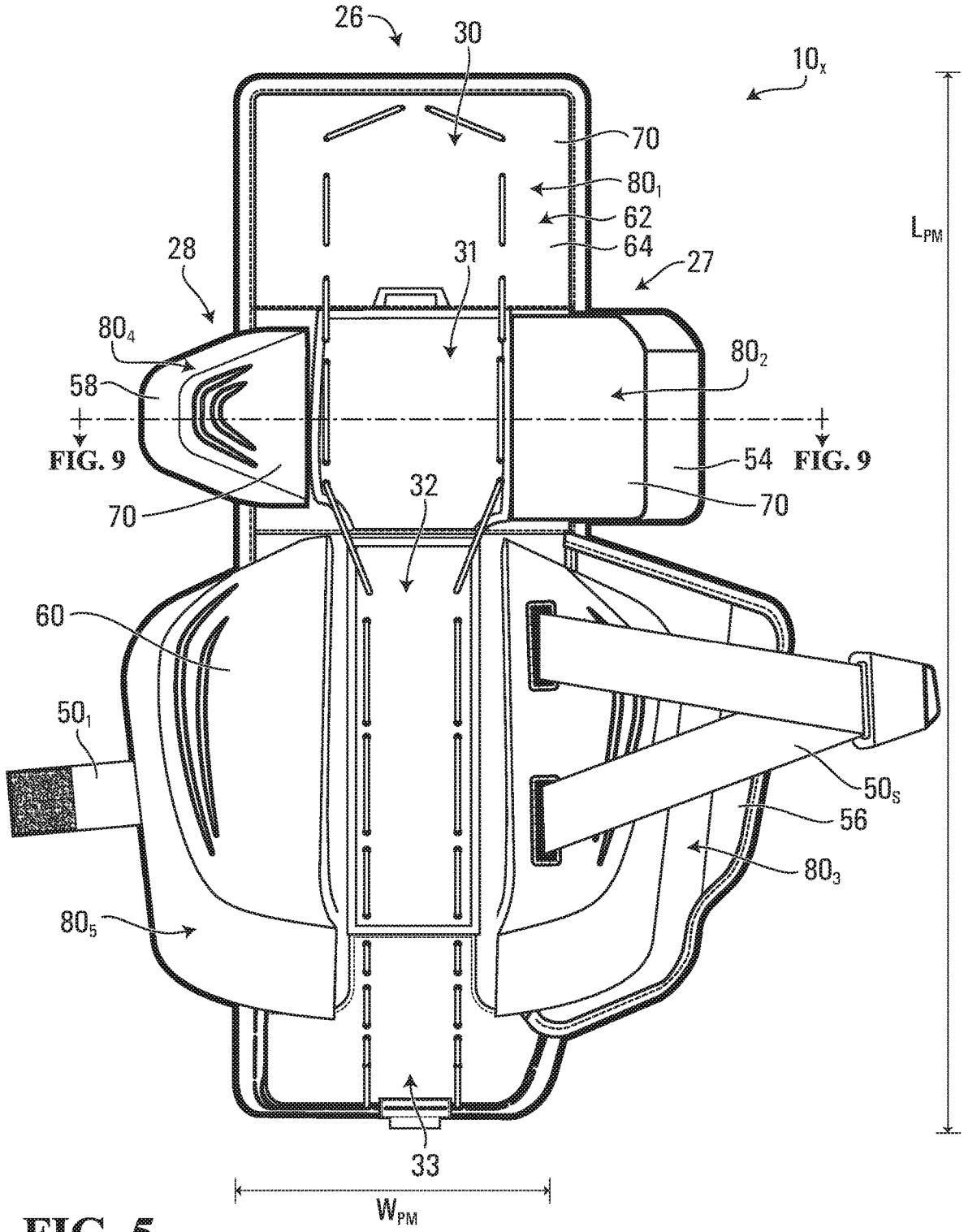
FIG. 5 shows an inner view of the leg pad.
Figure 6:
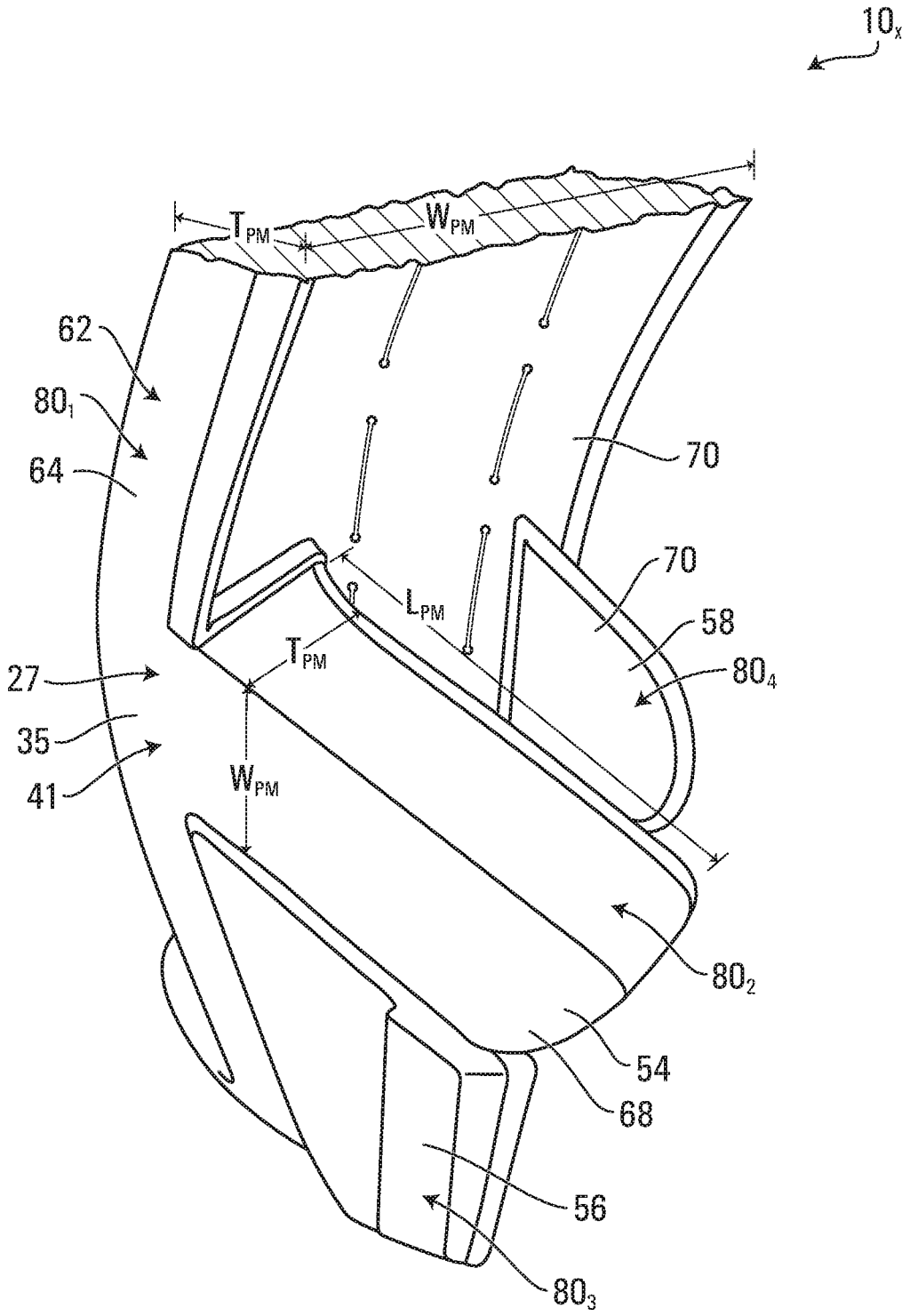
FIGS. 6 and 7 show perspective views of a portion of the leg pad.
Figure 7:
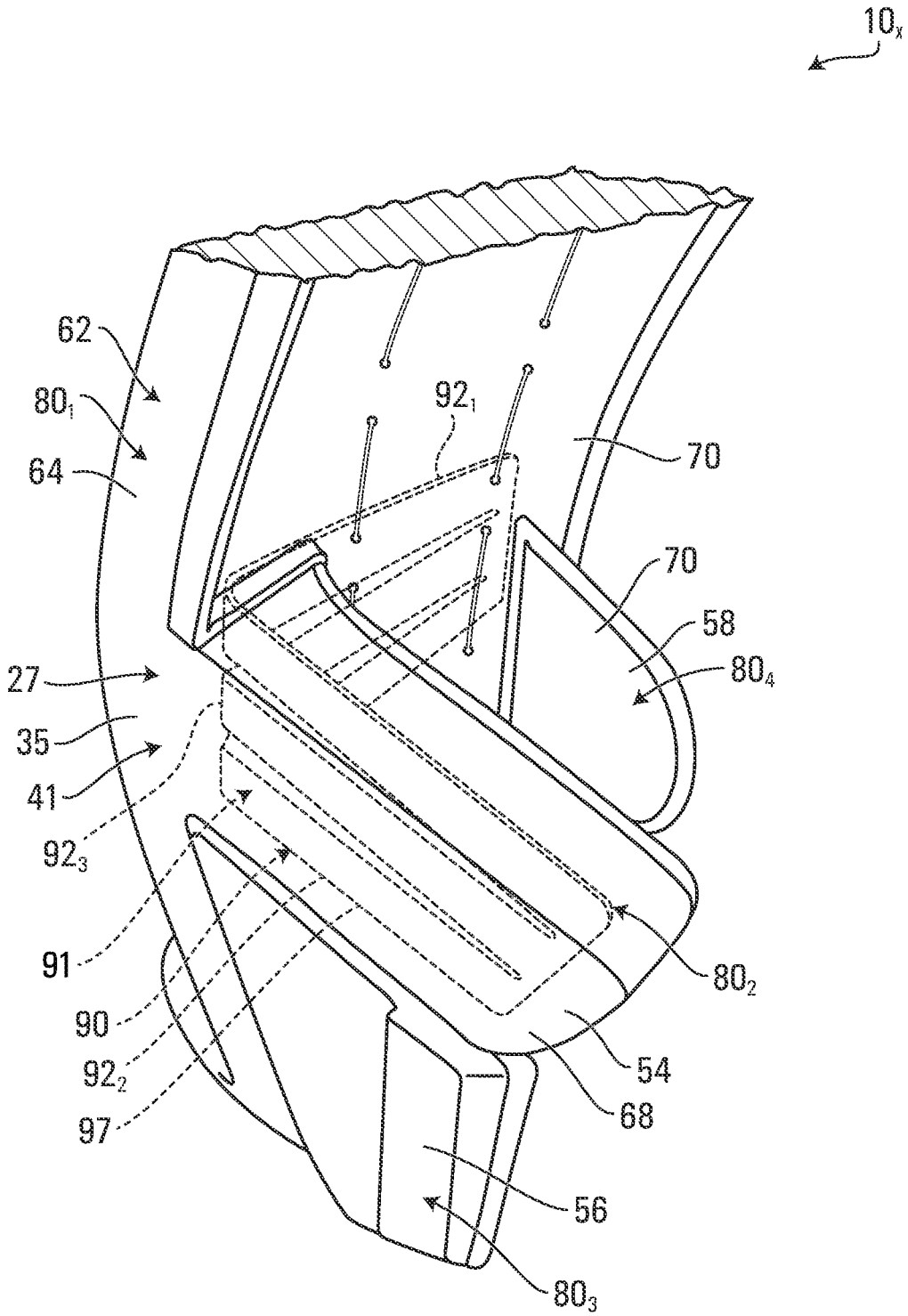
Figure 8:
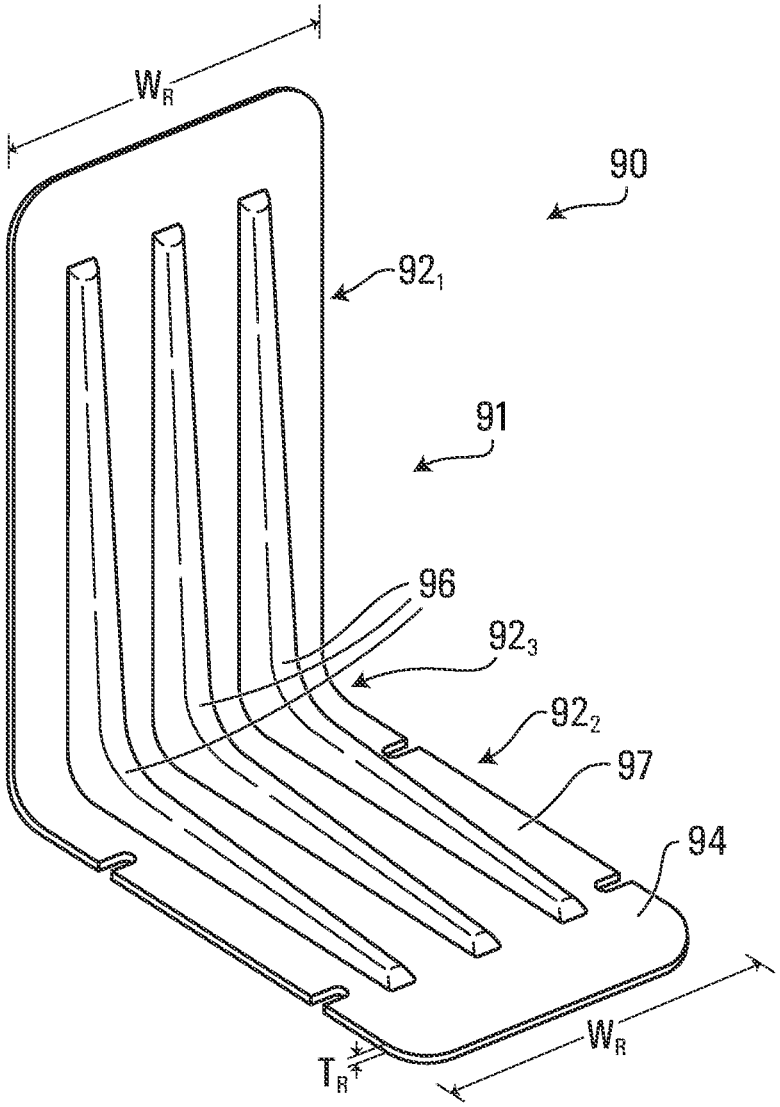
FIG. 8 shows a reinforcement.
Figure 9:
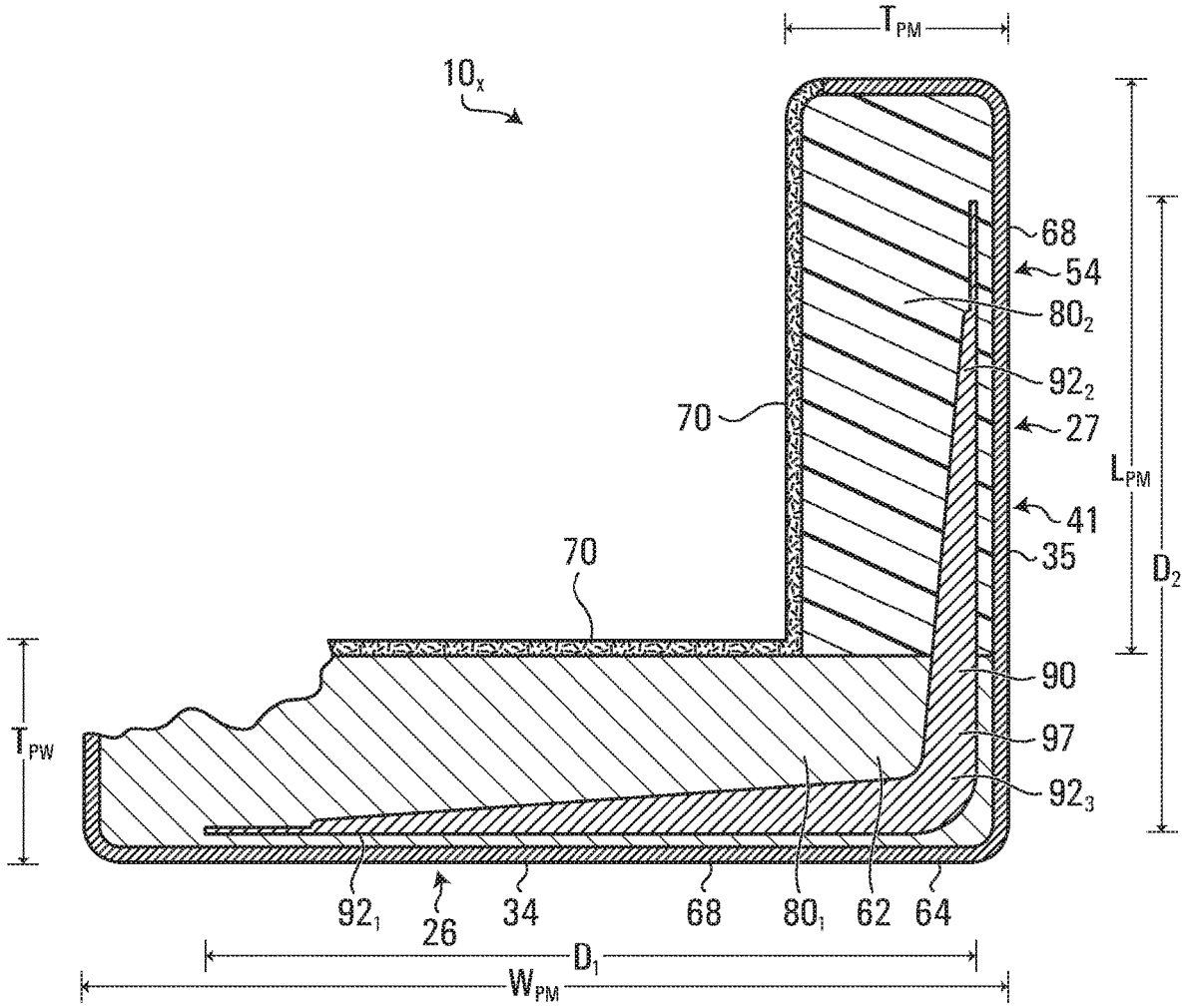
FIG. 9 shows a cross-sectional view of another portion of the leg pad.
Figure 10:
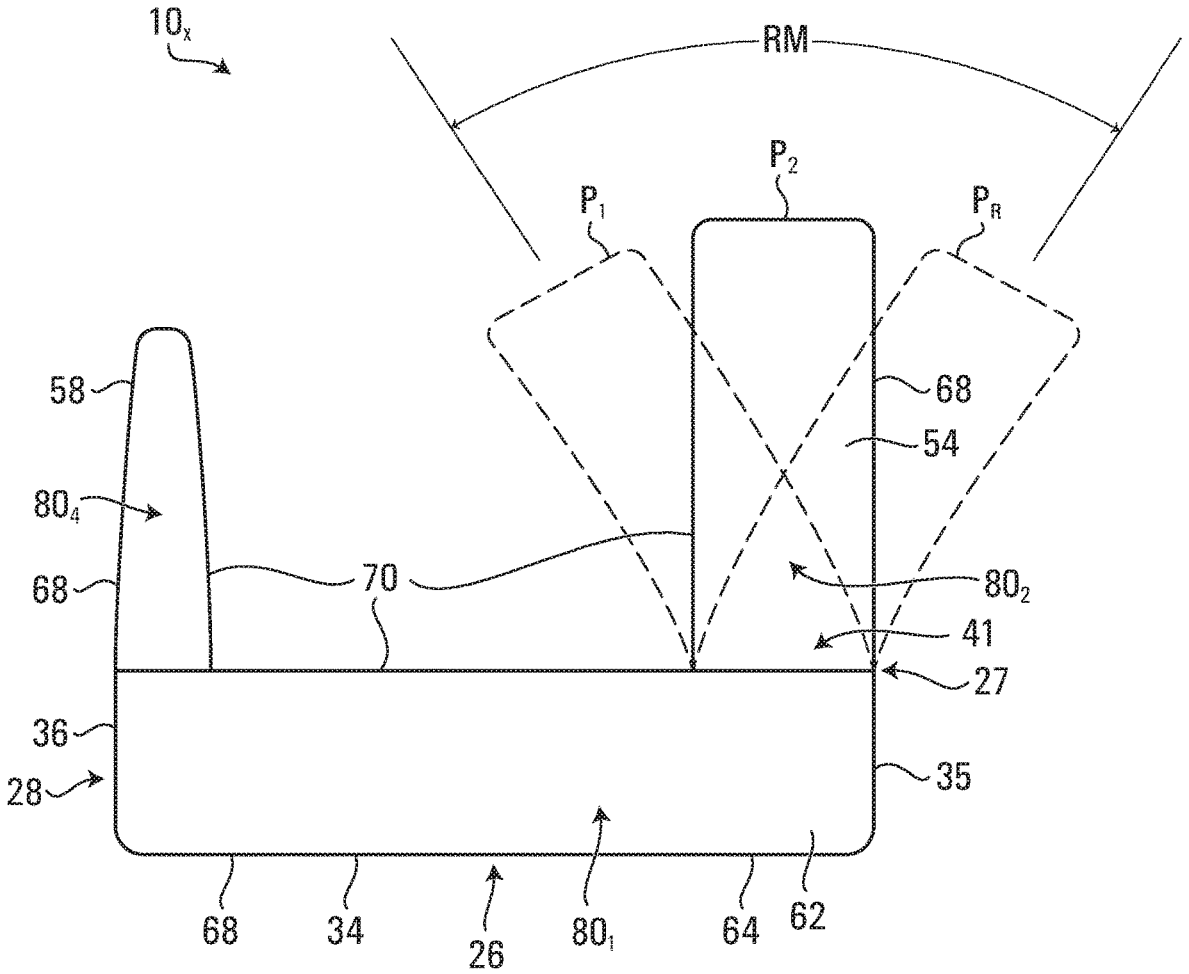
FIG. 10 shows a top view of the leg pad.

FIG. 1 shows an embodiment of hockey goalkeeper leg pads $\mathbf{10}_1$, $\mathbf{10}_2$ wearable on a hockey goalkeeper's legs $\mathbf{16}_1$, $\mathbf{16}_2$ while playing hockey to protect the legs $\mathbf{16}_1$, $\mathbf{16}_2$ against an impact from a puck, ball, hockey stick or other object and/or to protect the legs $\mathbf{16}_1$, $\mathbf{16}_2$ when moving (e.g., dropping) them onto a playing surface 12. The hockey goalkeeper may be referred to as a "goalie" and thus the hockey goalkeeper leg pads $\mathbf{10}_1$, $\mathbf{10}_2$ may be referred to as "goalie leg pads", "goalie pads", or just "leg pads" of the goalie. In this embodiment, a type of hockey played is ice hockey such that the goalie pads $\mathbf{10}_1$, $\mathbf{10}_2$ are ice hockey goalie pads, the goalie is an ice hockey goalie, and the playing surface 12 is ice.

As further discussed later, in this embodiment, the goalie pads $\mathbf{10}_1$, $\mathbf{10}_2$ may be configured to enhance performance, comfort and/or other aspects of goalkeeping of the goalie, including when the goalie pads $\mathbf{10}_1$, $\mathbf{10}_2$ drop onto the ice 12 to lie substantially horizontally on the ice 12 with their front facing play, such as in a "butterfly" position or otherwise.

Figure 41:
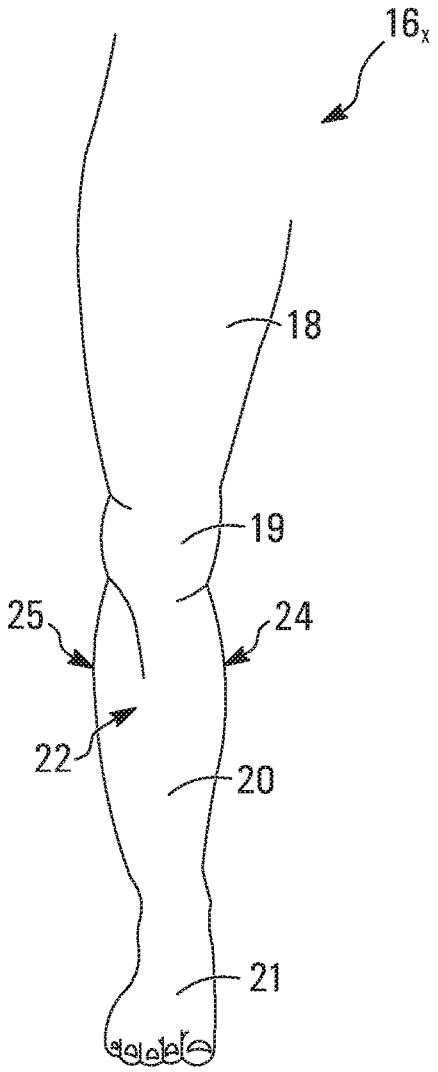
FIGS. 41 and 42 show a leg of the hockey goalkeeper.
Figure 42:
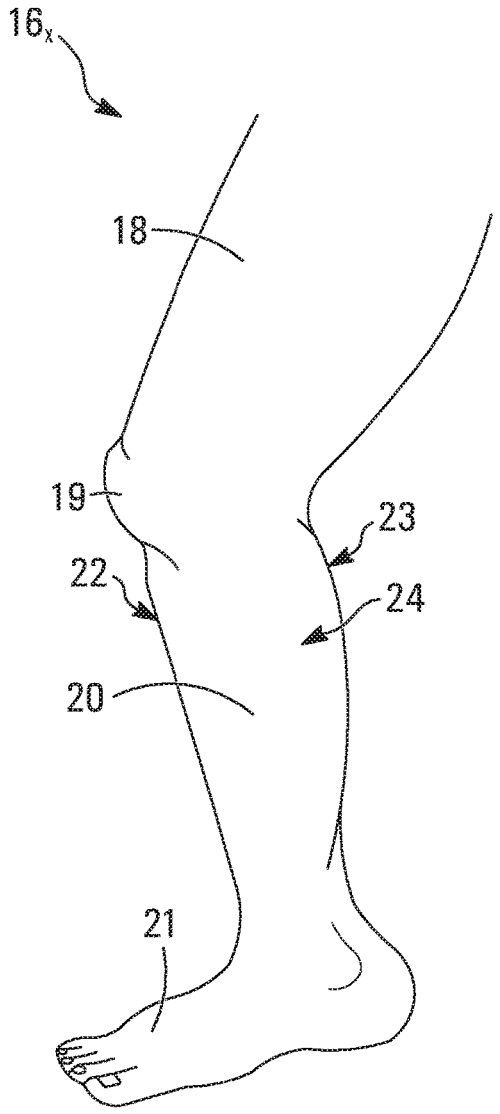

The goalie pads $\mathbf{10}_1$, $\mathbf{10}_2$ protect various regions of the goalie's legs $\mathbf{16}_1$, $\mathbf{16}_2$. With additional reference to FIGS. 41 and 42, each leg $\mathbf{16}_x$ of the goalie comprises an upper leg region 18, a knee 19, a lower leg region 20, and a foot 21. The upper leg region 18 is above the knee 19, while the lower leg region 20 is below the knee 19 and above the foot 21. The leg $\mathbf{16}_x$ of the goalie has a front 22, a back 23, a medial side 24 (sometimes referred to as an "inner side"), and a lateral side 25 (sometimes referred to as an "outer side").

With additional reference to FIGS. 2 to 10, each goalie pad $\mathbf{10}_x$ comprises an upper leg portion 30, a knee portion 31, a lower leg portion 32, and a foot portion 33 respectively configured to protect the upper leg region 18, the knee 19, the lower leg region 20, and the foot 21 of the goalie's leg $\mathbf{16}_x$ when the goalie pad $\mathbf{10}_x$ is worn on the leg $\mathbf{16}_x$. The upper leg portion 30 is above the knee portion 31, while the lower leg portion 32 is below the knee portion 31 and above the foot portion 33. Respective ones of these portions of the goalie pad $\mathbf{10}_x$ comprise frontal, medial, and lateral parts such that the goalie pad $\mathbf{10}_x$ comprises a front portion 26, a medial side portion 27, and a lateral side portion 28 respectively configured to overlie the front 22, the medial side 24, and the lateral side 25 of the goalie's leg $\mathbf{16}_x$ when the goalie pad $\mathbf{10}_x$ is worn on the leg $\mathbf{16}_x$. The front portion 26 comprises a front 34 of the goalie pad $\mathbf{10}_x$ and constitutes a bulk of the goalie pad $\mathbf{10}_x$, while the medial side portion 27 and the lateral side portion 28 respectively comprise a medial side 35 and a lateral side 36 of the goalie pad $\mathbf{10}_x$ and project rearwardly from the front portion 26. A longitudinal direction of the goalie pad $\mathbf{10}_x$ is substantially parallel to a longitudinal axis of the goalie's leg $\mathbf{16}_x$, a widthwise direction of the goalie pad $\mathbf{10}_x$ is perpendicular to its longitudinal direction and substantially parallel to a dextrosinistral axis of the goalie's leg $\mathbf{16}_x$, and a thicknesswise direction of the goalie pad $\mathbf{10}_x$ is perpendicular to its longitudinal direction and substantially parallel to a dorsoventral axis of the goalie's leg $\mathbf{16}_x$.

In this embodiment, the medial side portion 27 of the goalie pad $\mathbf{10}_x$ comprises medial side extensions 54, 56 that project rearwardly from the front portion 26 of the goalie pad $\mathbf{10}_x$. More particularly, in this embodiment, the medial side extension 54 is a medial side knee extension of the knee portion 31 that is configured to protect the goalie's knee 19, including by engaging the knee 19 when the goalie pad $\mathbf{10}_x$ drops onto the ice 12 as the goalie drives his/her knee 19 down and then presses it against the ice 12. In some cases, the medial side knee extension 54 may sometimes be referred to as a "knee landing" that may include "knee stacks" or "knee blocks". The medial side extension 56 is a medial side calf extension of the lower leg portion 32 that is configured to protect the goalie's lower leg region 20, including by engaging the lower leg region 20 when the goalie pad $\mathbf{10}_x$ drops onto the ice 12. In some cases, the medial side calf extension 56 may sometimes be referred to as a "calf plate". Also, in this embodiment, the lateral side portion 28 of the goalie pad $\mathbf{10}_x$ comprises lateral side extensions 58, 60 that project rearwardly from the front portion 26 of the goalie pad $\mathbf{10}_x$. The lateral side extension 58 is a lateral side knee extension of the knee portion 31, while the lateral side extension 60 is a lateral side calf extension of the lower leg portion 32. The medial and lateral side knee extensions 54, 58 define a knee cradle to receive the goalie's knee 19, while the medial and lateral side calf extensions 56, 60 define a lower leg channel to receive the goalie's lower leg region 20.

The goalie pad $\mathbf{10}_x$ can be secured to the goalie's leg $\mathbf{16}_x$ in any suitable way. In this embodiment, the goalie pad $\mathbf{10}_x$ comprises straps $\mathbf{50}_1$-$\mathbf{50}_S$ to secure it to the goalie's leg $\mathbf{16}_x$.

In this embodiment, the goalie pad $\mathbf{10}_x$ comprises padding 62 to provide padded protection to the goalie's leg $\mathbf{16}_x$ against an impact from a puck, ball, hockey stick or other object and/or when moving (e.g., dropping) it onto the ice 12, and a covering 64 that covers at least part of the padding 62.

The padding 62 is disposed in (i.e., part of) the upper leg portion 30, the knee portion 31, the lower leg portion 32, and the foot portion 33 of the goalie pad $\mathbf{10}_x$. To that end, the padding 62, which may sometimes be referred to as a "core" of the goalie pad $\mathbf{10}_x$, may comprise any suitable material. For example, in some embodiments, the padding 62 may comprise foam, such as polyurethane foam, ethylene vinyl acetate foam, polypropylene foam, polyethylene foam, vinyl nitrile foam, or any other suitable foam. As another example, in some embodiments, the padding 62 may comprise a material other than foam, such as a gel or any other suitable shock-absorbing material. In some cases, the padding 62 may comprise a plurality of padding layers of one or more padding materials (e.g., layers of different foams; a foam layer and a non-foam layer; etc.).

In this embodiment, the padding 62 comprises a plurality of pad members $\mathbf{80}_1$-$\mathbf{80}_P$ that are parts of the padding 62 which are disposed in the upper leg portion 30, the knee portion 31, the lower leg portion 32, and the foot portion 33 of the goalie pad $\mathbf{10}_x$. More particularly, in this embodiment, the pad member $\mathbf{80}_1$ is a front pad member that is part of the front portion 26 of the goalie pad $\mathbf{10}_x$ and may be referred to as a "main" pad member; the pad member $\mathbf{80}_2$ is a medial side knee pad member that is part of the medial side knee extension 54 of the medial side portion 27 of the goalie pad $\mathbf{10}_x$; the pad member $\mathbf{80}_3$ is a medial side calf pad member that is part of the medial side calf extension 56 of the medial side portion 27 of the goalie pad $\mathbf{10}_x$; the pad member $\mathbf{80}_4$ is a lateral side knee pad member that is part of the lateral side knee extension 58 of the lateral side portion 28 of the goalie pad $\mathbf{10}_x$; and the pad member $\mathbf{80}_5$ is a lateral side calf pad member that is part of the lateral side calf extension 60 of the lateral side portion 28 of the goalie pad $\mathbf{10}_x$. Each of the pad members $\mathbf{80}_1$-$\mathbf{80}_P$ has: a longitudinal direction defining a length $L_{PM}$ of that pad member; a widthwise direction defining a width $W_{PM}$ of that pad member; and a thicknesswise direction defining a thickness $T_{PM}$ of that pad member.

The covering 64 covers at least part of the padding 62 and may protect the padding 62, decorate the goalie pad $\mathbf{10}_x$ (e.g., include graphics), enhance performance (e.g., slidability, impact and rebound properties, etc.) of the goalie pad $\mathbf{10}_x$, and/or provide comfort to the goalie. In this embodiment, the covering 64 comprises an outer cover 68 and an inner cover 70 between which is disposed the padding 62.

The outer cover 68 is configured to face away from the goalie's leg $\mathbf{16}_x$. In this embodiment, the outer cover 68 has mechanical properties to facilitate the use of the goalie pad $\mathbf{10}_x$. For example, the outer cover 68 may have a reduced dynamical coefficient of friction with the playing surface 12, in this case ice. In some embodiments, a dynamical coefficient of friction of the outer cover 68 with ice may be no more than 0.7, in some cases no more than 0.5, in some cases no more than 0.3, in some cases no more than 0.2 and in some cases even less. The outer cover 68 may have any other dynamical coefficient of friction with the playing surface 12 in other embodiments.

The outer cover 68 may comprise any suitable material. For example, in some embodiments, the outer cover 42 may comprise a synthetic pliable material such as synthetic leather (e.g., polyurethane (PU) leather) or fabric (e.g., nylon fabric, polyester fabric, etc.) that may be provided as a panel or other piece cut into a desired shape. As another example, in some embodiments, the outer cover 68 comprise a molded material (e.g., molded foam such as ethylene vinyl acetate foam, polyethylene foam, polyurethane foam, polypropylene foam, etc.; non-foam polymeric material such as thermoplastic polyurethane or any other elastomeric material, a gel, etc.) that is formed by a molding process such that the outer cover 68 is a molded cover, such as described, for instance, in U.S. Patent Application Publication 2015/0033433 incorporated by reference herein. In some cases, the outer cover 68 may comprise a plurality of layers of one or more materials (e.g., different fabrics, a foam layer and a non-foam layer, etc.).

The inner cover 70 is configured to face the goalie's leg $\mathbf{16}_x$. It may comprise any suitable material. For example, in some embodiments, the inner cover 70 may comprise a fabric such as a woven fabric, a nonwoven fabric, synthetic microfibers, a synthetic woven knit, a polyurethane laminate, a mesh, or any other suitable fabric. The inner cover 70 may be implemented in various other ways in other embodiments.

The covering 64 and the padding 62 may be connected together in any suitable way. For example, in some embodiments, two or more of the outer cover 68, the inner cover 70, and the padding 62 may be fastened by one or more fasteners, such as a stitching (i.e., a series of stitches), an adhesive, a series of staples, one or more laces, etc.

In this embodiment, the goalie pads $\mathbf{10}_x$ may be configured to enhance performance, comfort and/or other aspects of goalkeeping of the goalie, including when the goalie pad $\mathbf{10}_x$ drop onto the ice 12 to lie substantially horizontally on the ice 12 with its front 34 facing play, such as in a butterfly position or otherwise.

Notably, in this embodiment, respective ones of the medial and lateral side knee and calf extensions 54, 56, 58, 60 may be better connected to a remainder of the goalie pad $\mathbf{10}_x$ and/or reinforced so as to be more stable, responsive and supportive for the goalie.

More particularly, in this embodiment, the front pad member $\mathbf{80}_1$ and the medial side knee pad member $\mathbf{80}_2$ are interconnected, i.e., connected to one another between one another. That is, a connection 41 of the front pad member $\mathbf{80}_1$ and the medial side knee pad member $\mathbf{80}_2$ is between the front pad member $\mathbf{80}_1$ and the medial side knee pad member $\mathbf{80}_2$. The connection 41 of the front pad member $\mathbf{80}_1$ and the medial side knee pad member $\mathbf{80}_2$ is such that they are connected to one another directly or by a connecting element (e.g., fastener) between them.

Figure 11:
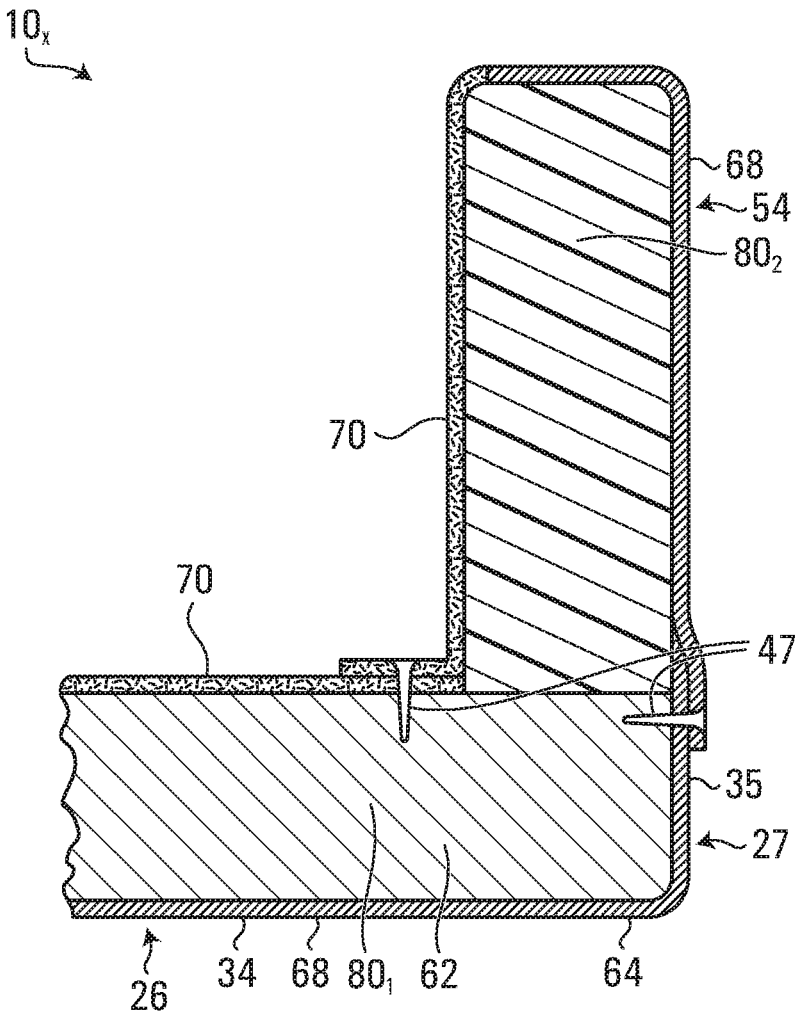
FIGS. 11 to 13 show cross-sectional views of variants of the leg pad.
Figure 12:
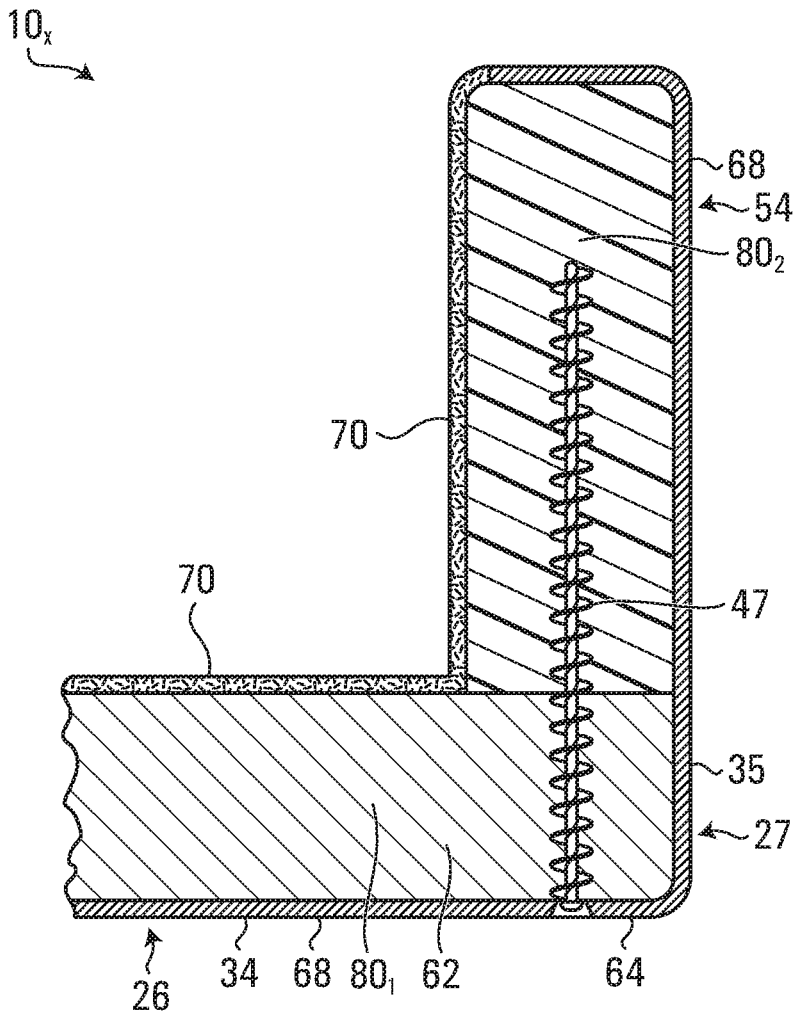
Figure 13:
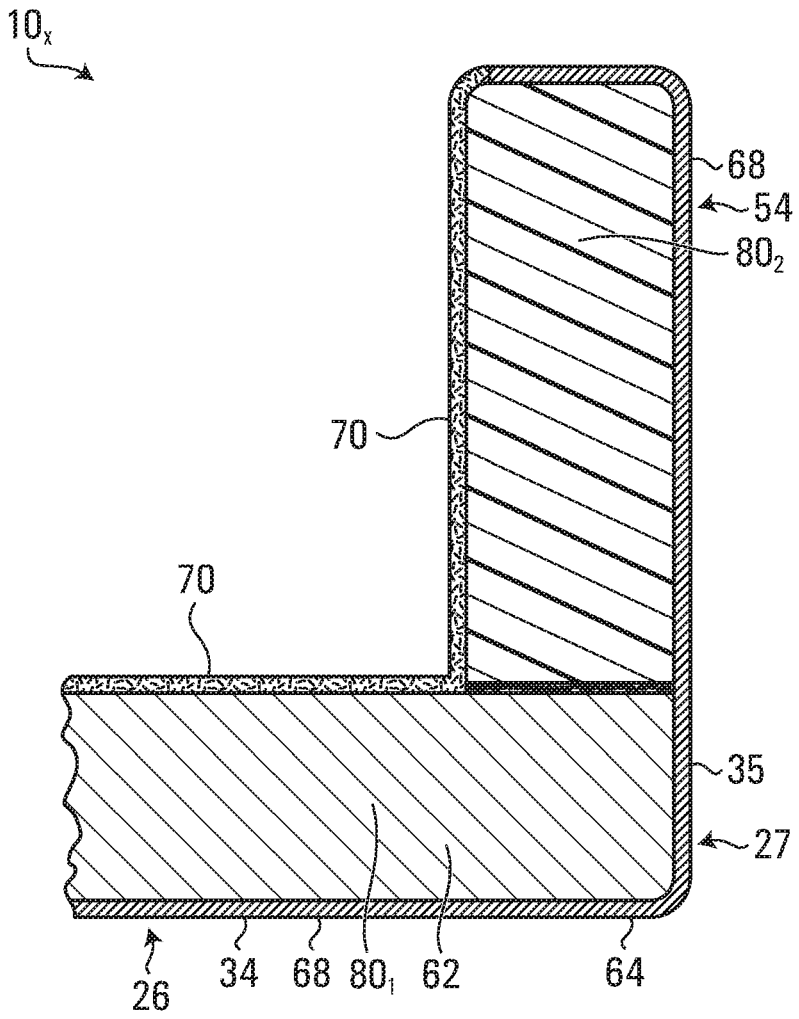
Figure 14A:
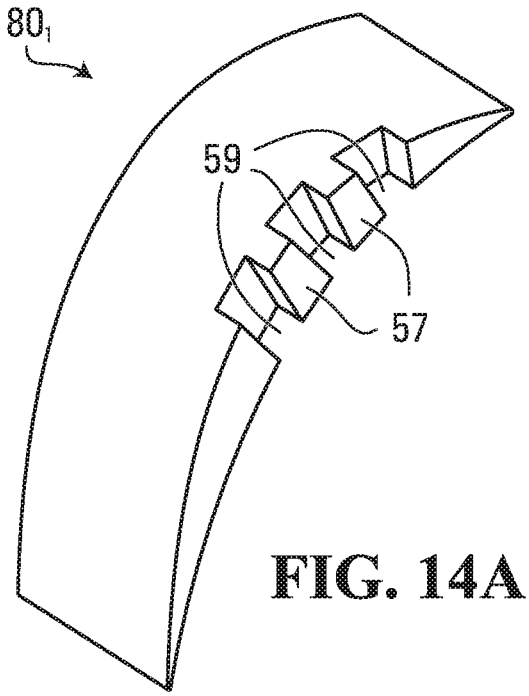
FIGS. 14A to 14C show perspective views of variants of the leg pad.
Figure 14B:
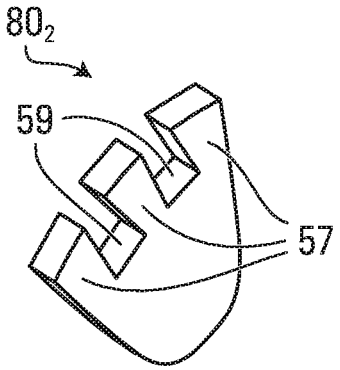
Figure 14C:
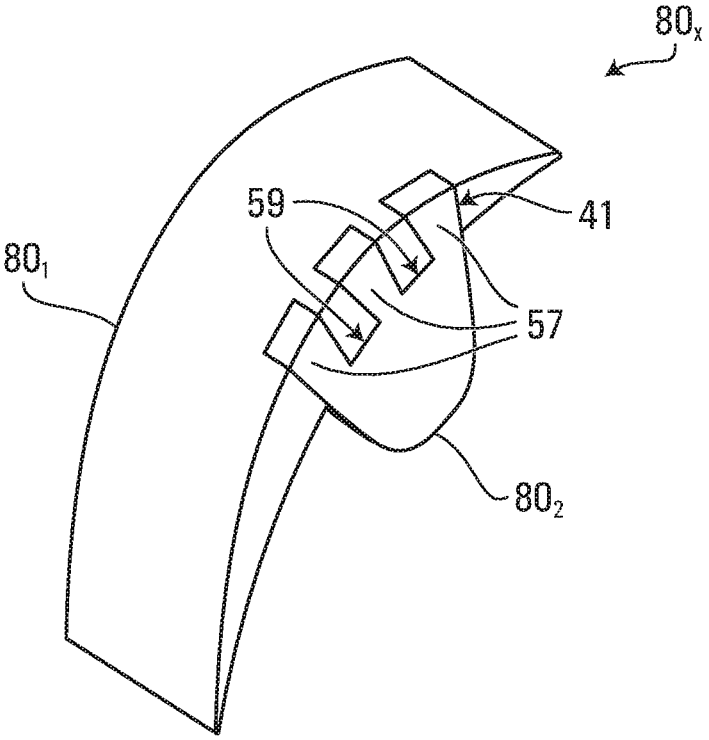
Figure 15A:
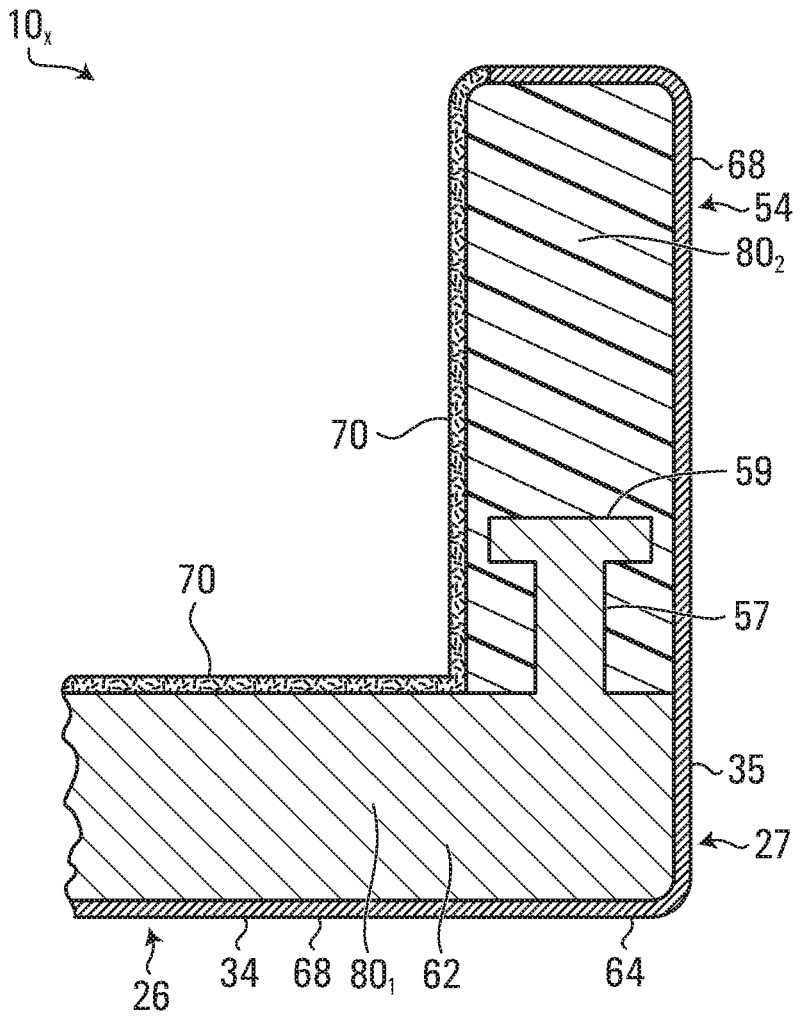
FIGS. 15A to 17 show cross-sectional views of variants of the leg pad.
Figure 15B:
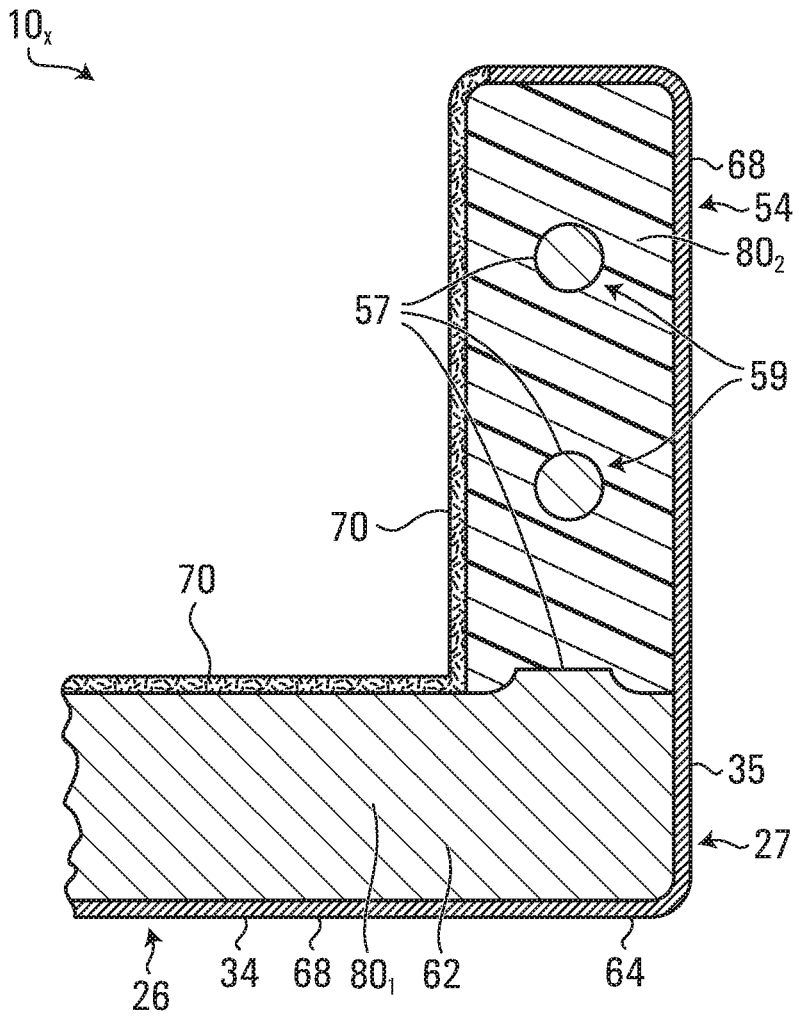
Figure 16:
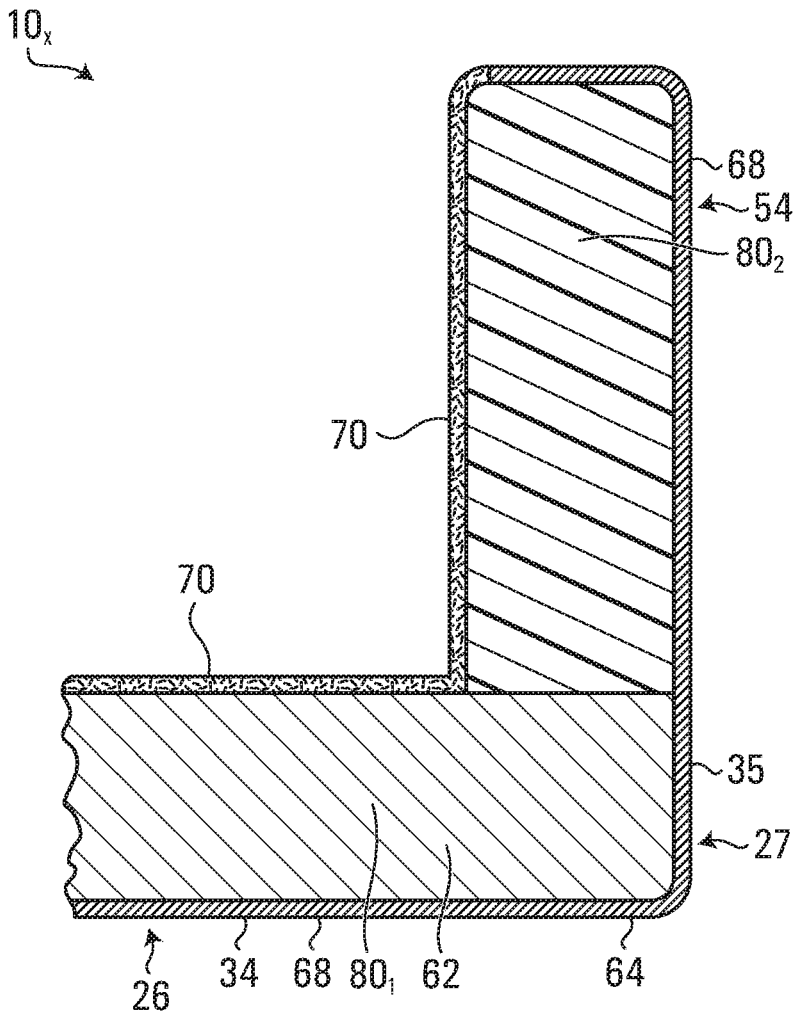
Figure 23:
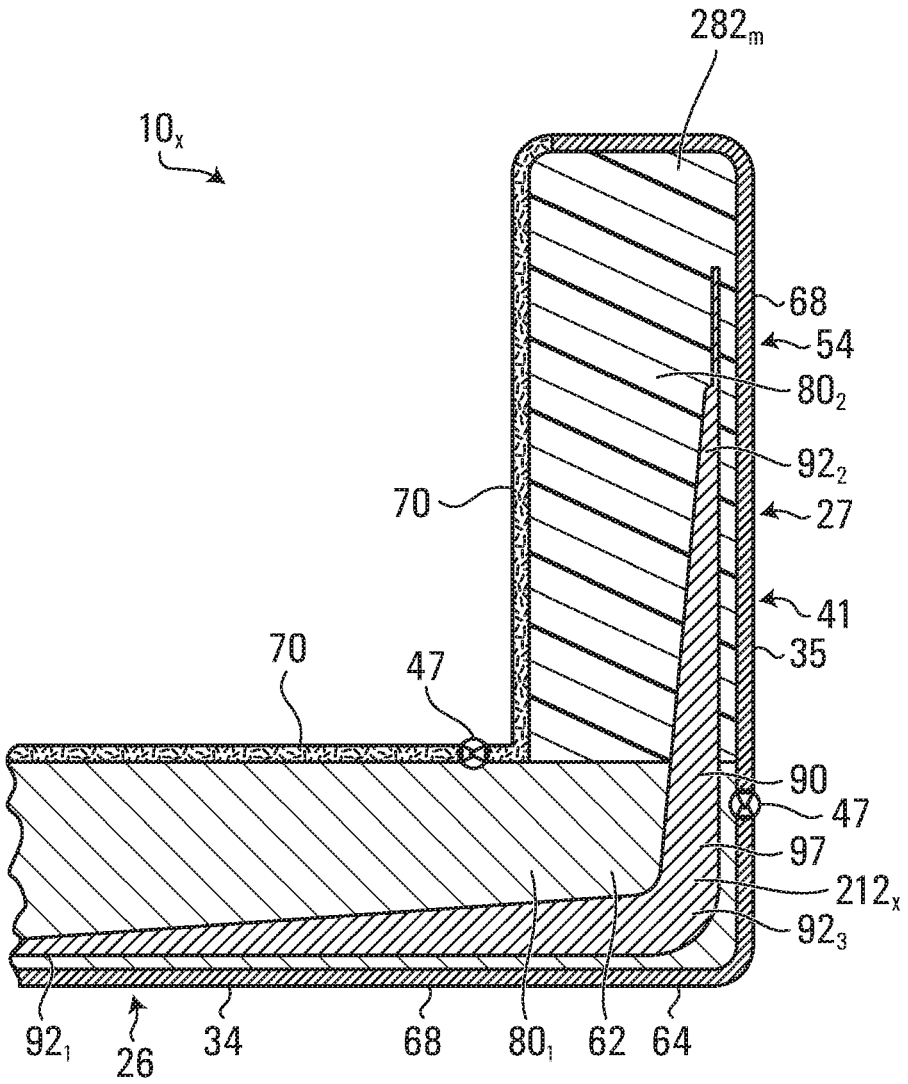
FIGS. 23 to 40 show variants of the leg pad.

For example, in some embodiments, as shown in FIGS. 11 to 13, the front pad member $\mathbf{80}_1$ and the medial side knee pad member $\mathbf{80}_2$ may be fastened together by a fastener 47 between them. In some examples, as shown in FIG. 13, the fastener 47 may be an adhesive (e.g., a polyurethane adhesive, an acrylic adhesive, a chloroprene adhesive, synthetic rubber, another water-based or solvent-based adhesive, etc.) such that the front pad member $\mathbf{80}_1$ and the medial side knee pad member $\mathbf{80}_2$ are adhesively bonded to one another. In other examples, as shown in FIGS. 11, 12 and 23, the fastener 47 may be a mechanical fastener (e.g., a screw or other threaded fastener, a rivet, a clip, a zip fastener, etc.) such that the front pad member $\mathbf{80}_1$ and the medial side knee pad member $\mathbf{80}_2$ are mechanically fastened together. In such examples, the front pad member $\mathbf{80}_1$ and the medial side knee pad member $\mathbf{80}_2$ may be contiguous.

As another example, in some embodiments, as shown in FIG. 14A to 15B, instead of or in addition to being fastened together, the front pad member $\mathbf{80}_1$ and the medial side knee pad member $\mathbf{80}_2$ may be mechanically interlocked with one another. That is, an interlocking part 57 of a given one of the front pad member $\mathbf{80}_1$ and the medial side knee pad member $\mathbf{80}_2$ extends into an interlocking space 59 (e.g., one or more holes, one or more recesses, and/or one or more other hollow areas) of the other one of the front pad member $\mathbf{80}_1$ and the medial side knee pad member $\mathbf{80}_2$. For example, in some embodiments, one of the front pad member $\mathbf{80}_1$ and the medial side knee pad member $\mathbf{80}_2$ penetrates, and as such extends from, the other one of the front pad member $\mathbf{80}_1$ and the medial side knee pad member $\mathbf{80}_2$.

Figure 17:
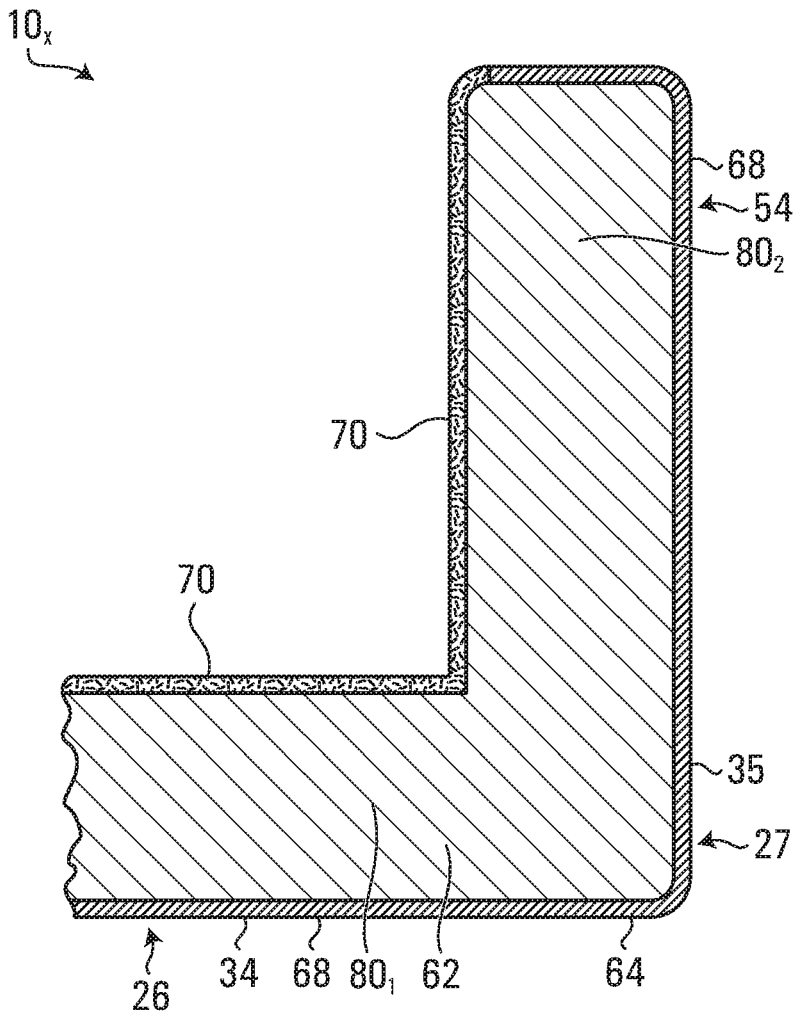

As yet another example, in some embodiments, as shown in FIG. 17, the front pad member $\mathbf{80}_1$ and the medial side knee pad member $\mathbf{80}_2$ may be integrally formed with one another. For instance, in some embodiments, the front pad member $\mathbf{80}_1$ and the medial side knee pad member $\mathbf{80}_2$ may be formed from a one-piece element (e.g., of foam or other suitable material) that is shaped so that they lie transversally to one another. In some cases, this may be done by shaping the front pad member $\mathbf{80}_1$ and the medial side knee pad member $\mathbf{80}_2$ together in a mold. In other cases, this may be done by forming a hinge where the connection 41 of the front pad member $\mathbf{80}_1$ and the medial side knee pad member $\mathbf{80}_2$ is located. In such examples, the front pad member $\mathbf{80}_1$ and the medial side knee pad member $\mathbf{80}_2$ are contiguous.

In this embodiment, the front pad member $\mathbf{80}_1$ and the medial side knee pad member $\mathbf{80}_2$ are connected to one another independently of a connection of the covering 64 and the padding 62. That is, the connection of the front pad member $\mathbf{80}_1$ and the medial side knee pad member $\mathbf{80}_2$ is independent from the connection of the covering 64 and the padding 62. Thus, the front pad member $\mathbf{80}_1$ and the medial side knee pad member $\mathbf{80}_2$ are connected to one another even without the connection of the covering 64 and the padding 62. For example, one or more fasteners, such as a stitching, a lace, or an adhesive connecting the covering to the padding is not used to connect the front pad member $\mathbf{80}_1$ and the medial side knee pad member $\mathbf{80}_2$ together.

For example, in this embodiment, the outer cover 68 and the inner cover 70 may be fastened together, and the front pad member $\mathbf{80}_1$ and the medial side knee pad member $\mathbf{80}_2$ are connected to one another independently of fastening of the outer cover 68 and the inner cover 70. That is, the connection of the front pad member $\mathbf{80}_1$ and the medial side knee pad member $\mathbf{80}_2$ is independent from how the outer cover 68 and the inner cover 70 are fastened together. Thus, the front pad member $\mathbf{80}_1$ and the medial side knee pad member $\mathbf{80}_2$ are connected to one another even without the outer cover 68 and the inner cover 70 being fastened together. For example, one or more fasteners, such as a stitching, a lace, or an adhesive fastening the outer cover 68 and the inner cover 70 is not used to connect the front pad member $\mathbf{80}_1$ and the medial side knee pad member $\mathbf{80}_2$ together.

An angle between the longitudinal direction of the front pad member $\mathbf{80}_1$ and the longitudinal direction of the medial side knee pad member $\mathbf{80}_2$ at rest may have any suitable value, and may be acute, right or obtuse. For example, in some embodiments, the angle between the longitudinal direction of the front pad member $\mathbf{80}_1$ and the longitudinal direction of the medial side knee pad member $\mathbf{80}_2$ may be between 60° and 120°, in some cases between 80° and 100°, and in some cases about 90°. Thus, in some embodiments, the front pad member $\mathbf{80}_1$ and the medial side knee pad member $\mathbf{80}_2$ lie substantially perpendicularly to one another.

In some embodiments, the medial side knee pad member $\mathbf{80}_2$ may be thicker than the front pad member $\mathbf{80}_1$ where the medial side portion 27 of the goalie pad $\mathbf{10}_x$ projects rearwardly from the front portion 26 of the goalie pad $\mathbf{10}_x$. In other embodiments, the medial side knee pad member $\mathbf{80}_2$ may be as thick as or less thick than the front pad member $\mathbf{80}_1$ where the medial side portion 27 of the goalie pad $\mathbf{10}_x$ projects rearwardly from the front portion 26 of the goalie pad $\mathbf{10}_x$ With continued reference to FIGS. 1 to 10, in this embodiment, the goalie pad $\mathbf{10}_x$ comprises a reinforcement 90 disposed in the front portion 26 and the medial side portion 27 of the goalie pad $\mathbf{10}_x$, such that the front portion 26 comprises a front reinforcing member $\mathbf{92}_1$ of the reinforcement 90 and the medial side portion 26 comprises a medial side reinforcing member $\mathbf{92}_2$ of the reinforcement 90. The front reinforcing member $\mathbf{92}_1$ and the medial side reinforcing member $\mathbf{92}_2$ are respectively adjacent to and stiffer than the front pad member $\mathbf{80}_1$ and the medial side knee pad member $\mathbf{80}_2$. The front reinforcing member $\mathbf{92}_1$ and the medial side reinforcing member $\mathbf{92}_2$ are interconnected, i.e., connected to one another between one another. That is, a connection 51 of the front reinforcing member $\mathbf{92}_1$ and the medial side reinforcing member $\mathbf{92}_2$ is between the front reinforcing member $\mathbf{92}_1$ and the medial side reinforcing member $\mathbf{92}_2$. The connection 51 of the front reinforcing member $\mathbf{92}_1$ and the medial side reinforcing member $\mathbf{92}_2$ is such that they are connected to one another directly or by a connecting element (e.g., fastener) between them.

For example, in some embodiments, the reinforcement 90 may comprise a bracket 91. The front reinforcing member $\mathbf{92}_1$ of the reinforcement 90 may be a portion of the bracket 91 that extends into the front portion 26 of the goalie pad $\mathbf{10}_x$. Similarly, the medial side reinforcing member $\mathbf{92}_2$ of the reinforcement 90 may be a portion of the bracket 91 that extends into the medial portion 27 of the goalie pad $\mathbf{10}_x$. In this example, the front reinforcing member $\mathbf{92}_1$ has a dimension $D_1$ in either one of or in both the longitudinal direction and the widthwise direction of the front portion 26 of the goalie pad $\mathbf{10}_x$, and the medial side reinforcing member $\mathbf{92}_2$ has a dimension $D_2$ in either one of or in both the longitudinal direction and the widthwise direction of the medial side portion 27 of the goalie pad $\mathbf{10}_x$.

More specifically, in this example, the front reinforcing member $\mathbf{92}_1$ and the medial side reinforcing member $\mathbf{92}_2$ are substantially flat and connected by a bend $\mathbf{92}_3$. In some cases, the front reinforcing member $\mathbf{92}_1$ and the medial side reinforcing member $\mathbf{92}_2$ are angled to one another by an angle between 60° and 120°, in some cases between 80° and 100°, in some cases about 90°. The front reinforcing member $\mathbf{92}_1$ and the medial side reinforcing member $\mathbf{92}_2$ may thus lie substantially perpendicularly to one another. In this case, the reinforcement 90 is L-shaped. In other embodiments, the front reinforcing member $\mathbf{92}_1$ and the medial side reinforcing member $\mathbf{92}_2$ are shaped to conform to a shape of the inner cover 70 of the pad members $\mathbf{80}_1$, $\mathbf{80}_2$, and/or to conform to the shape of the goalie's leg.$\mathbf{16}_x$.

In this embodiment, the front reinforcing member $\mathbf{92}_1$ and the medial side reinforcing member $\mathbf{92}_2$ are contiguous and extend from one another. More particularly, in this example, the front reinforcing member $\mathbf{92}_1$ and the medial side reinforcing member $\mathbf{92}_2$ are integrally formed with one another, i.e., form a unitary structure. For example, in some cases, the front reinforcing member $\mathbf{92}_1$ and the medial side reinforcing member $\mathbf{92}_2$ may be connected by the bend $\mathbf{92}_3$ during molding to form the unitary structure, or may be bent at the bend $\mathbf{92}_3$ after molding (e.g., while still hot). In other cases, the reinforcement 90 may be manufactured by injection molding, 3d printing, or any suitable manufacturing process.

In other examples, the front reinforcing member $\mathbf{92}_1$ and the medial side reinforcing member $\mathbf{92}_2$ may not be integrally formed with one another.

For instance, in some examples, the front reinforcing member $\mathbf{92}_1$ and the medial side reinforcing member $\mathbf{92}_2$ may be fastened together. The front reinforcing member $\mathbf{92}_1$ and the medial side reinforcing member $\mathbf{92}_2$ are fastened together by at least one fastener extending from the front reinforcing member $\mathbf{92}_1$ to the side reinforcing member $\mathbf{92}_2$. A fastener may be an adhesive or a mechanical fastener such as a screw or other threaded fastener, a rivet, a clip, or any other suitable fastening element. In some examples, also, the front reinforcing member $\mathbf{92}_1$ and the medial side reinforcing member $\mathbf{92}_2$ are held together by mechanical interlock.

The reinforcement 90 has a geometry that facilitates its use. For example, the reinforcement 90 may comprise one or more ribs or other projections and/or one or more recesses, apertures or other voids to facilitate affixing the reinforcement 90 to a remainder of the front portion 26 and the medial side portion 27 of the goalie pad $\mathbf{10}_x$ and/or to adjust (i.e., increase or diminish) rigidity of the reinforcement 90. For instance, in this embodiment, the reinforcement 90 comprises a base 94 and one or more ribs 96. The ribs 96 extend from the front reinforcing member 92 to the side reinforcing member $\mathbf{92}_2$.

As another example, the reinforcement 90 has a thickness $T_r$ and a width $W_r$. suitable for reinforcing. For instance, the thickness $T_r$ and the width $W_r$ of the reinforcement 90 may be great enough to impart a sufficient rigidity to the reinforcement 90, but also small enough to be light and easily insertable into the front portion 26 and the medial side portion 27 of the goalie pad $\mathbf{10}_x$. In this embodiment, the thickness $T_r$ of the reinforcement 90 varies and the width $W_e$ of the reinforcement 90 is substantially constant. Other implementations are possible in other embodiments (i.e., the thickness $T_r$ of the reinforcement 90 and/or the width $W_e$ of the reinforcement 90 may vary or be substantially constant as desired).

In this embodiment, the base 94 the reinforcement 90 has a thickness $T_B$ that facilitates the use of the reinforcement 90 in a similar manner. In this embodiment, the thickness $T_B$ of the base 94 is substantially constant. For example, in some cases, the thickness $T_B$ of the base 94 is no more than 5 mm; in some cases no more than 3 mm; in some cases no more than 1.5 mm, and in some cases even less. In other embodiments, the thickness $T_B$ of the base 94 may vary.

In this embodiment, the reinforcement 90 comprises a rigid material 97 that is more rigid than padding material of the front pad member $\mathbf{80}_1$ and medial side knee pad member $\mathbf{80}_2$ to impart rigidity to the front portion 26 and medial side portion 27 of the goalie pad $\mathbf{10}_x$. For example, in some embodiments, a ratio of a modulus of elasticity of the rigid material 97 of the reinforcement 90 over a modulus of elasticity of the padding material of the front pad member $\mathbf{80}_1$ and medial side knee pad member $\mathbf{80}_2$ may be at least 1.5, in some cases at least 2, in some cases at least 3, and in some cases even more. For instance, in some embodiments, the modulus of elasticity of the rigid material 97 may be at least 500 MPa, in some cases at least 1500 MPa, in some cases at least 100 000 MPa, in some cases even more. The rigid material 97 may be of any suitable kind. For instance, in some embodiments, the rigid material 97 may comprise a metallic material, and in other embodiments, the rigid material 97 may comprise a polymeric material (e.g., a polymer or a fiber-reinforced polymer). For instance, in this embodiment, the rigid material 97 may comprise: thermoplastic composite (CURV), HDPE, other high density foams, polypropylene, fiberglass composite, carbon composite, aramid composite, ABS, to name a few.

In some embodiments, since, the ribs 96 of the reinforcement 90 may diminish or increase the rigidity, i.e., the resistance to bend inwardly or outwardly, of the reinforcement 90, this may diminish or increase the resistance to bend inwardly or outwardly of the connection 41 of the front portion 26 and the medial side portion 27 of the goalie pad $\mathbf{10}_x$. The resistance to bend inwardly or outwardly of the connection 41 of the front portion 26 and the medial side portion 27 of the goalie pad $\mathbf{10}_x$ may be characterized by a rotational stiffness which takes into account a rotational load (e.g., moment) and a deformation caused by that rotational load. A relatively high rotational stiffness of the connection 41 means that the connection 41 is relatively rigid, which may be of use to make the goalie pad $\mathbf{10}_x$ more reactive to movements of the goalie's leg 16*x*. For example, in some cases, the rotational stiffness of the connection 41 is at least 1000 N·mm per degree, in some cases at least 2000 N·mm per degree, in some cases at least 5000 N·mm per degree, in some cases at least 10 000 N·mm per degree and in some cases even more. The rotational stiffness of the connection 41 may have any other value in other embodiments.

The connection 41 of the front portion 26 and the medial side portion 27 of the goalie pad $\mathbf{10}_x$ may also be characterized by a range of motion RM. The range of motion RM defines every position $P_1, P_2, \ldots, P_r$ that the medial side portion 27 can have relative to the front portion 26. For instance, a more rigid connection 41 may reduce the range of motion RM of the connection 41. In some embodiments, the range of motion RM of the connection 41 may be no more than 30°, in some cases no more than 20°, in some cases no more than 10°, in some cases no more than 5°.

In this embodiment, the rotational stiffness of the connection 41 is substantially the same for every position $P_1, P_2, \ldots, P_r$ of the medial side portion 27 relative to the front portion 26. In other embodiments, the rotational stiffness of the connection 41 may substantially change over the range of motion RM. That is, for some of the positions $P_1, P_2, \ldots, P_r$ of the medial side portion 27 relative to the front portion 26, the rotational stiffness of the connection 41 may be substantially higher than for others ones of the positions $P_1, P_2, \ldots, P_r$.

Figure 18:
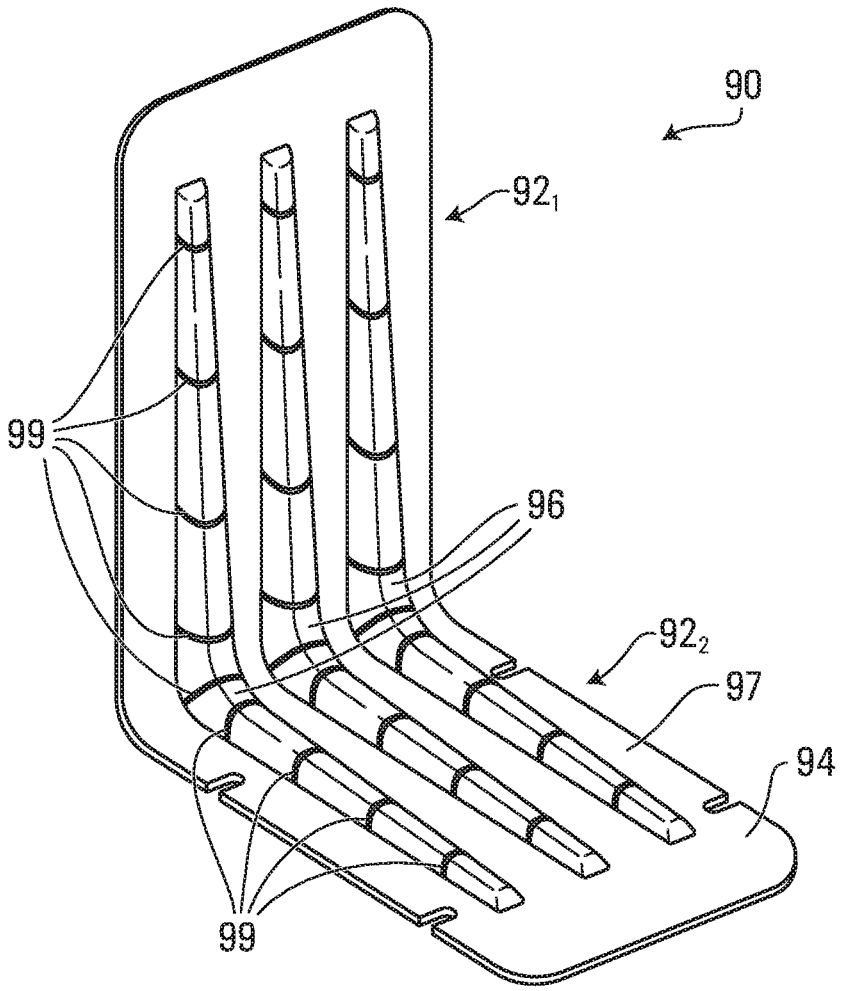
FIGS. 18 to 22 show variants of the reinforcement.
Figure 19:
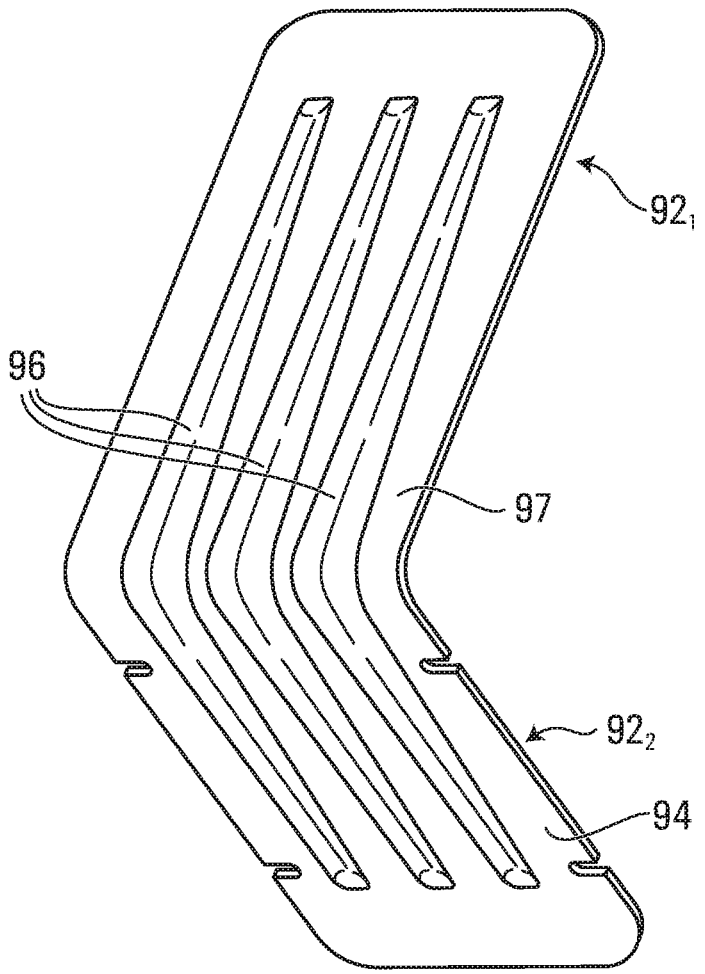
Figure 20:
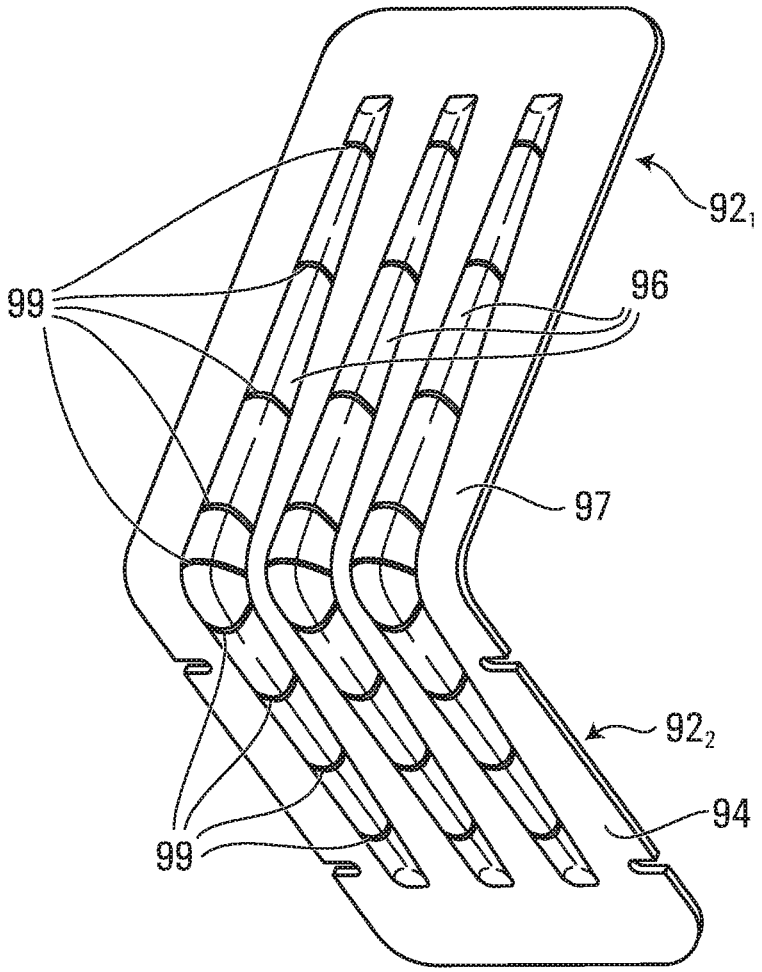

In this embodiment, for every position $P_1, P_2, \ldots, P_r$ of the medial side portion 27 relative to the front portion 26, the rotational stiffness of the connection 41 is substantially the same in the inward and outward directions. In other embodiments, as shown in FIGS. 18 and 20, the ribs 96 comprise grooves 99 such that, for at least one of the positions $P_1, P_2, \ldots, P_r$ of the medial side portion 27 relative to the front portion 26, the rotational stiffness of the connection 41 substantially varies depending on whether the connection 41 is rotated outwardly or inwardly.

Although in the embodiment described above, the goalie pad $\mathbf{10}_x$ comprises one reinforcement 90, in other embodiments, the goalie pad $\mathbf{10}_x$ may comprise 2, 3, 4 or more reinforcements 90. In some embodiments, more than one reinforcement 90 may be disposed in the front portion 26 and the medial side portion 27 of the goalie pad $\mathbf{10}_x$.

Figure 21:
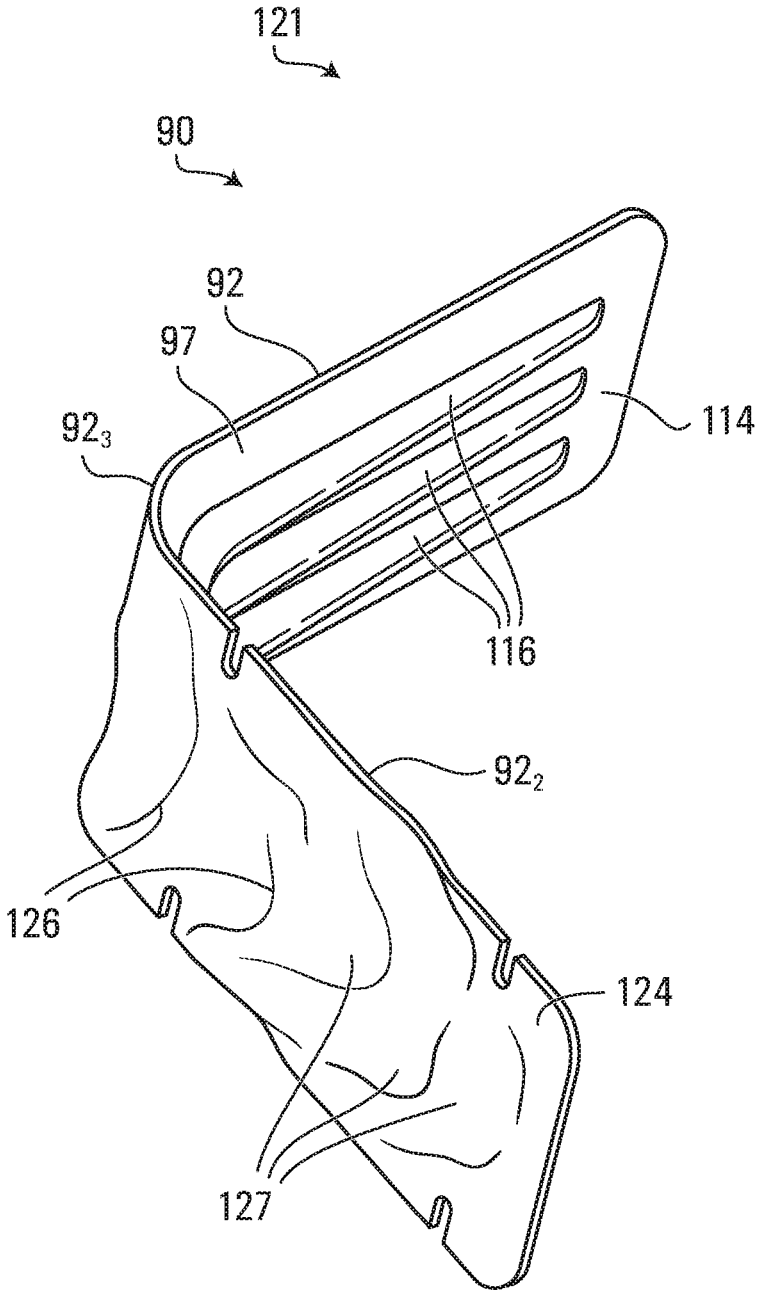

With additional reference to FIG. 21, in some embodiments, the reinforcement 90 may be a customized reinforcement 112 to tightly fit onto the goalie's leg $\mathbf{16}_x$. For example, in some embodiments, a scan file 110 of the goalie's leg $\mathbf{16}_x$ is obtained (e.g., by manually taking measurements, by using a scanner and scanning platform, by using multiple images from different angles and using photogrammetry) and used to produce the customized reinforcement 112.

In this embodiment, the customized reinforcement 112 may comprise a base 114 and ribs 116. The base 114 comprises an outer surface 124, which may be view as a 3D shape and comprises recesses 126 and projections 127 to correspond to recesses and projections of (i.e., the 3D shape of) the goalie's leg $\mathbf{16}_x$. In some embodiments, the thickness $T_B$ of the base 114 is substantially constant, while in other embodiments the thickness $T_B$ of the base 114 substantially varies.

The customized reinforcement 112 may be manufactured in any suitable way. For instance, in some embodiments, a custom mold in produced using the scan file 110 of the goalie's leg $\mathbf{16}_x$ and the customized reinforcement 112 is molded into the custom mold. In other embodiments, a pre-existing mold is selected from a plurality of pre-existing molds using the scan file 110 and the customized reinforcement 112 is molded into the selected pre-existing mold. In other embodiments, a base connector is produced in a standard mold and machined into the customized reinforcement 112, using dimensions derived from the scan file 110. In some embodiments, the reinforcement 90 is hammered over a custom last that reproduces features of the goalie's leg $\mathbf{16}_x$, to change the 3D shape of the reinforcement 90 into the 3D shape of the customized reinforcement 112. In some embodiments, the rigid material 97 of the reinforcement 90 is thermoformable and the reinforcement 90 is heated and thermoformed into a desired shape to become the customized reinforcement 112. Other manufacturing methods may also be contemplated.

Figure 22:
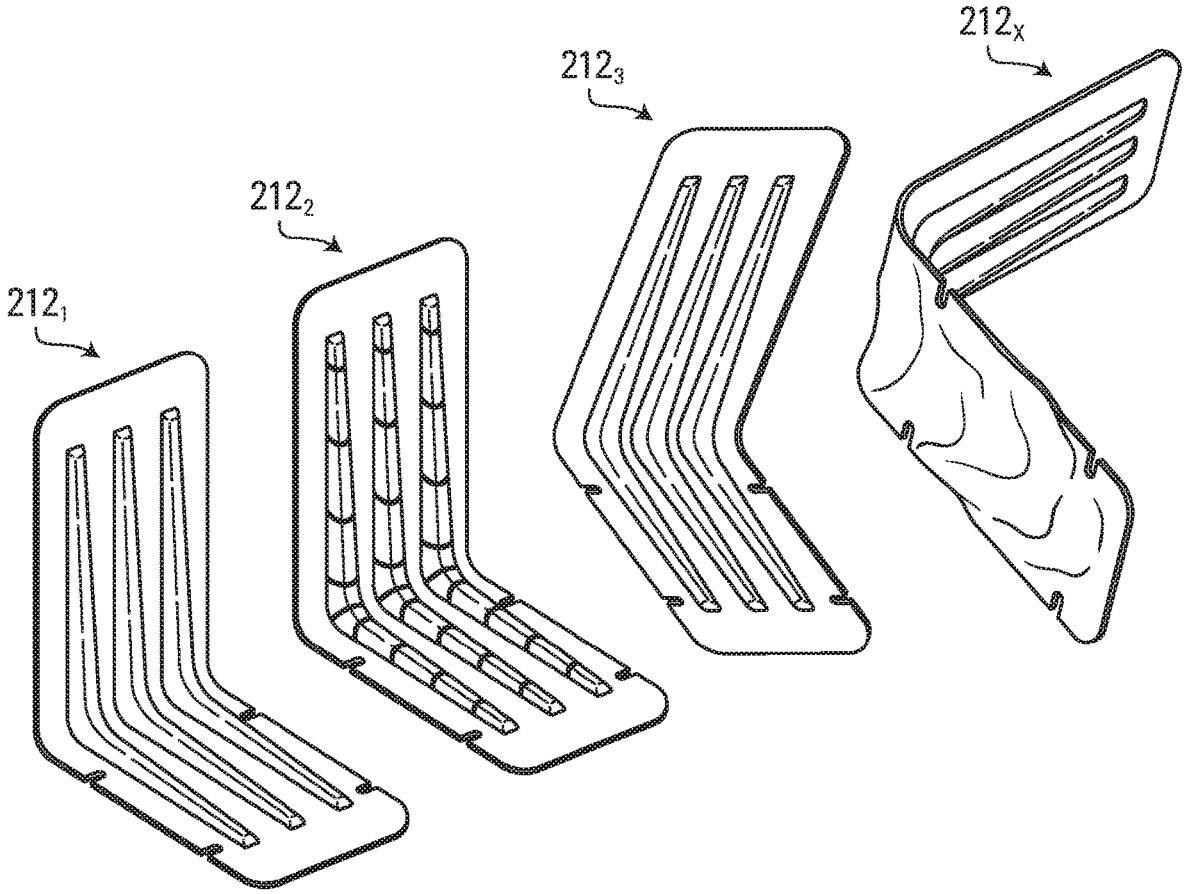
Figure 24:
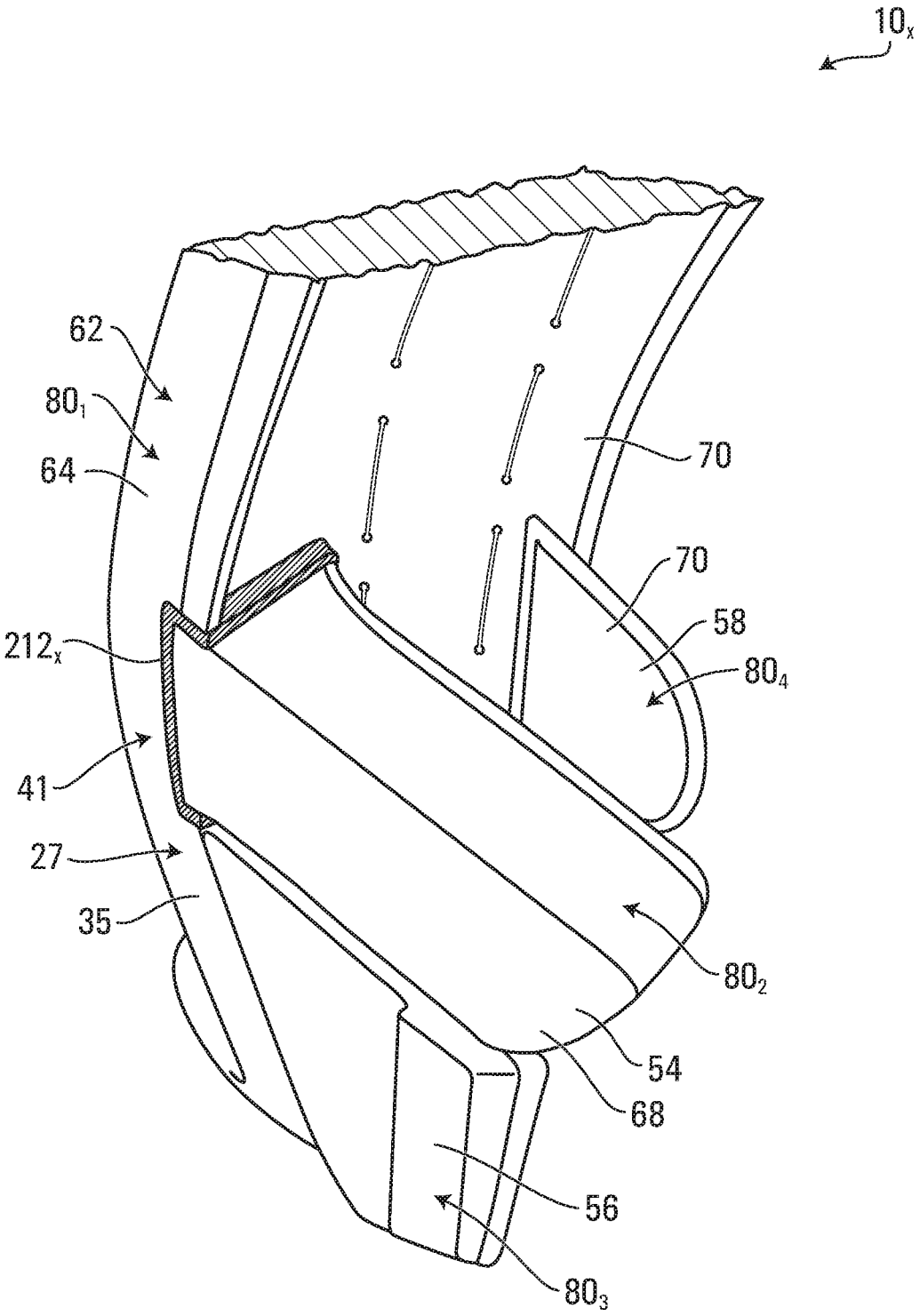

With additional reference to FIGS. 22 to 24, in some embodiments, the reinforcement 90 is an interchangeable reinforcement $\mathbf{212}_1$ interchangeable with a plurality of reinforcements $\mathbf{212}_2, \mathbf{212}_3, \ldots, \mathbf{212}_r$. In this embodiment, the interchangeable reinforcement $\mathbf{212}_1$ is removable from the medial side portion 27 and from the front portion 26. Once the interchangeable reinforcement $212_1$ is removed from the medial side portion 27 and from the front portion 26, another one of the reinforcements $212_2$, $212_3$, . . . , $212_r$ may be inserted in the front portion 26 and in the medial side portion 27. Each of the reinforcements $212_1$, $212_2$, $212_3$, . . . , $212_r$ may have different properties (e.g., weight, rigidity, geometry, size, etc.), thus allowing the user to change adjust the leg pad $10_x$ to his/her needs and/or to replace a used or broken reinforcement $255_r$.

Similarly, in some embodiments, the medial side knee pad member $80_2$ is an interchangeable medial side knee pad member $282_1$ interchangeable with a plurality of medial side knee pad members $282_2$, $282_3$, . . . , $282_m$. In this embodiment, the medial side knee pad member $282_1$ is removable from the connection 41 and from the front portion 26 of the goalie pad $10_x$. Once the interchangeable medial side knee pad member $282_1$ is removed from the connection 41 and from the front portion 26, another one of the medial side knee pad members $282_2$, $282_3$, . . . , $282_m$ may be inserted in the front portion 26 and in the medial side portion 27. Each of the medial side knee pad members $282_1$, $282_2$, . . . , $282_m$ may have different properties, e.g., different shape, different materials, different size, different weight, etc. Some of the medial side knee pad members $282_1$, $282_2$, . . . , $282_m$ may be me customized or customizable to the goalie's leg $16_x$. This allows the user to change adjust the leg pad $10_x$ to his/her needs and/or to replace a used or broken medial side knee pad member $282_m$.

Figure 25:
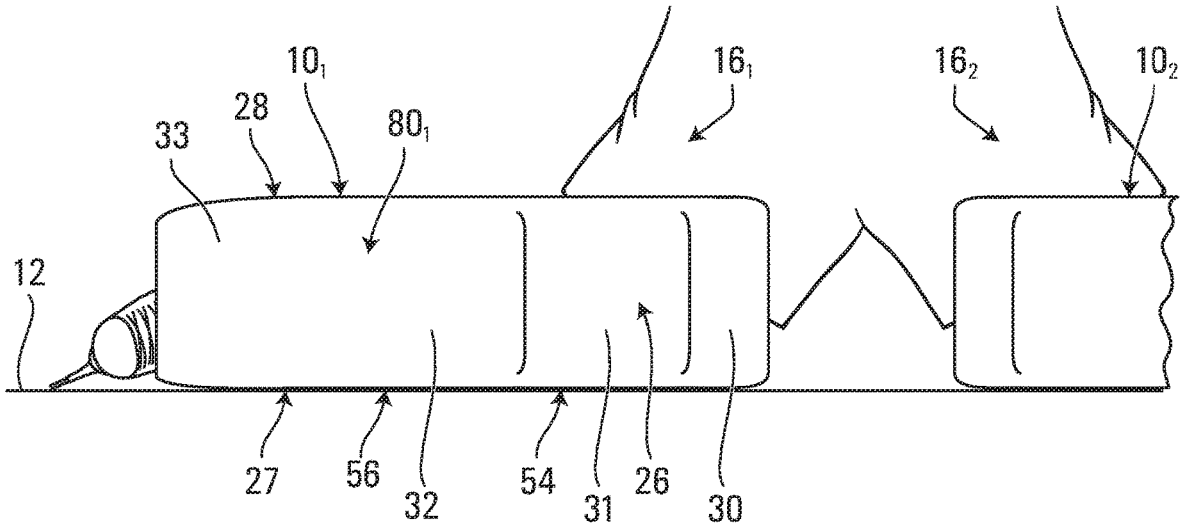
Figure 26:
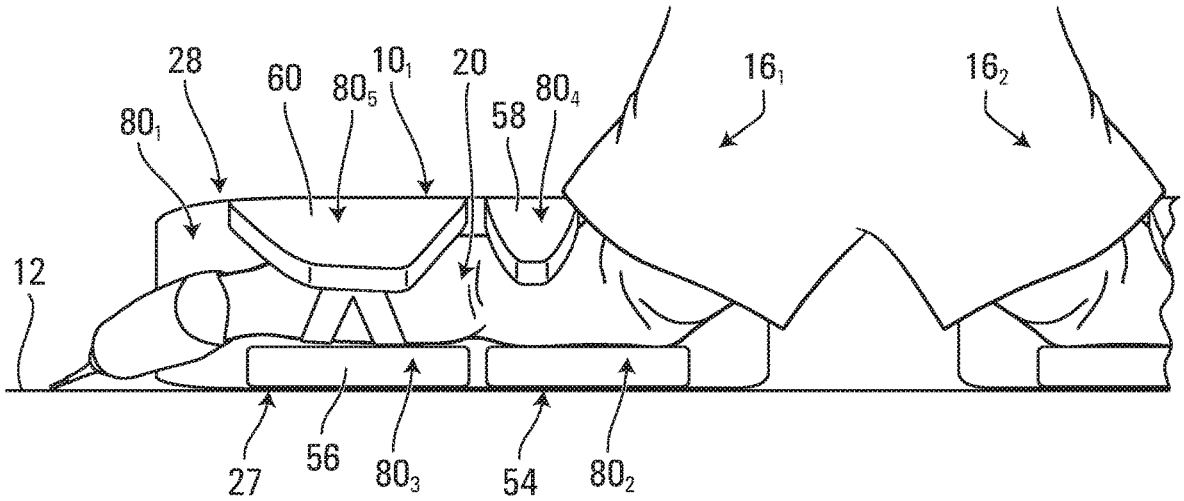

In this embodiment, as shown in FIGS. 25 and 26, the medial side calf extension 56 is configured to bear loading from the lower leg region 20 of the goalie when the medial side knee extension 54 engages the ice 12. This may help to better support and distribute a load on the goalie's leg $16_x$ when the goalie pad $10_x$ lies substantially horizontally on the ice 12, such as in the butterfly position or otherwise.

For example, in some embodiments, a thickness $T_{mc}$ of the medial side calf extension 56 may be such that, when the medial side knee extension 54 contacts the ice, at least part of the medial side calf extension 56 contacts the ice to support at least a substantial part of a weight of the lower leg region 20 of the goalie's leg $16_x$. For instance, in some embodiments, the thickness $T_{mc}$ of the medial side calf extension 56 may be such that, when the medial side knee extension 54 contacts the ice, at least a majority (i.e., a majority or an entirety) of a dimension of the medial side calf extension 56 from a front 71 to a rear 73 of the medial side calf extension 56 contacts the ice. In some cases, the thickness $T_{mc}$ of the medial side calf extension 56 may be such that, when the medial side knee extension 54 contacts the ice, the medial side calf extension 56 compresses between the lower leg region 20 of the goalie's leg $16_x$ and the ice over at least a majority of the dimension of the medial side calf extension 56 from a front 71 to a rear 73 of the medial side calf extension 56.

For instance, in some embodiments, a ratio of the thickness $T_{mc}$ of the medial side calf extension 56 over a thickness $T_{fc}$ of the front portion 26 of the goalie pad $10_x$ where the medial side calf extension 56 projects rearwardly from the front portion 26 may be at least 0.05, in some cases at least 0.1, in some cases at least 0.5, and in some case even larger. Where the thickness $T_{mc}$ of the medial side calf extension 56 varies, it can be taken at its maximum value. Similarly, where the thickness $T_{fc}$ of the front portion 26 of the goalie pad $10_x$ where the medial side calf extension 56 projects rearwardly from the front portion 26, it can be taken as its maximum value.

As an example, in some embodiments, this may be achieved by adjusting (e.g., increasing) a thickness of the medial side calf pad member $80_3$.

Figure 27:
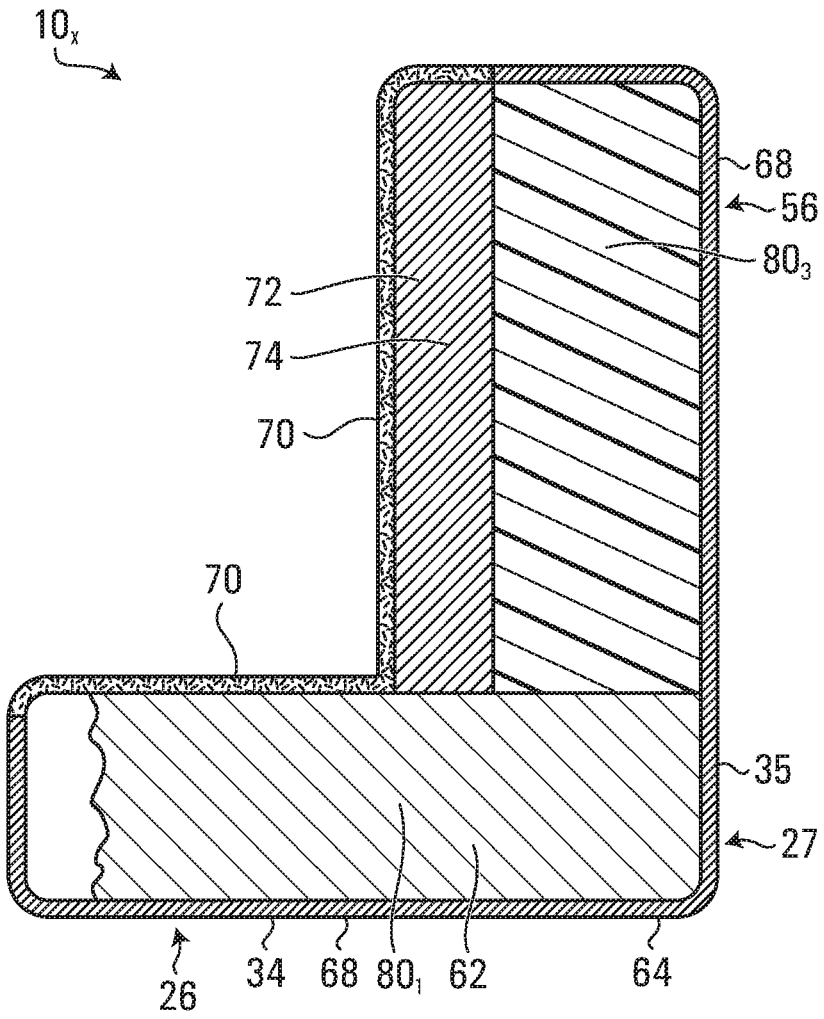
Figure 28:
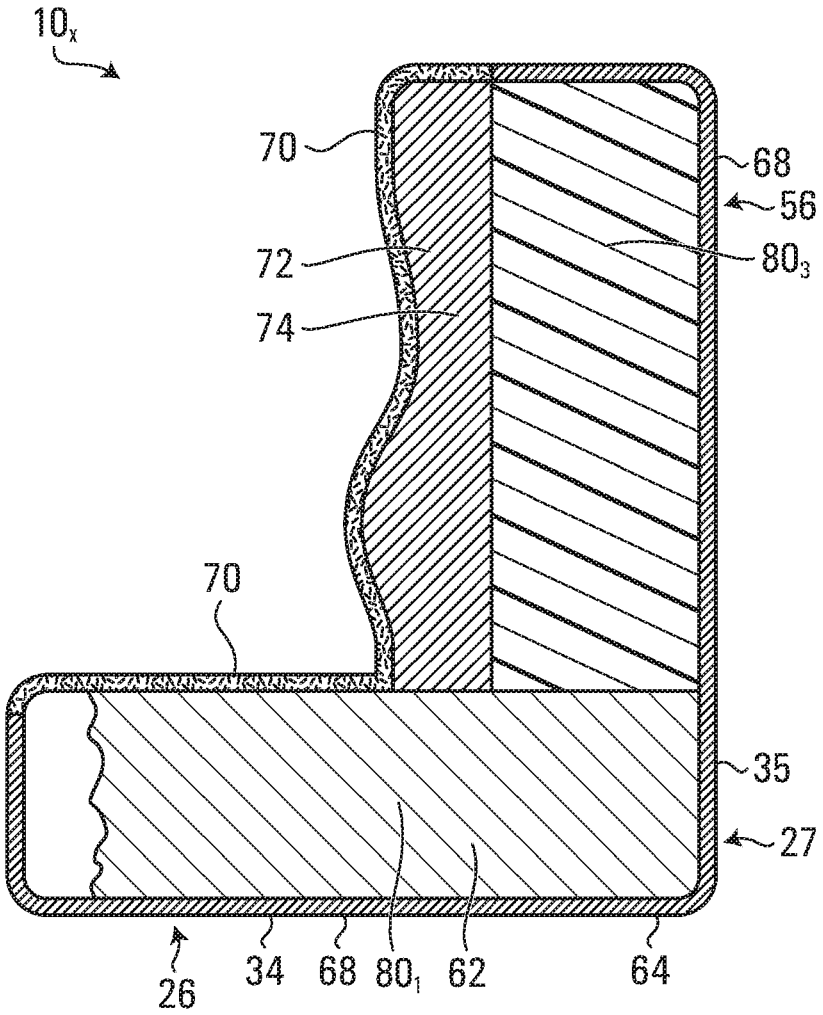

As another example, in some embodiments, as shown in FIGS. 27 and 28, the medial side calf extension 56 may comprise a load-supporting element 72 between an inner surface of the medial side calf extension 56 and the medial side calf pad member $80_3$. The load-supporting element 72 may have a specific thickness suitable for supporting and distributing load. For instance, in some cases, the element 72 may have a thickness between 5 mm and 100 mm, in some cases between 25 mm and 75 mm, in some cases about 50 mm. In some embodiments, the thickness of the element 72 may vary, while in some embodiments the thickness of the element 72 is substantially the same throughout the element 72. The element 72 may comprise a material 74 having mechanical properties suitable for supporting and distributing load. For instance, the material 74 may be a resilient material. Also, the material 74 may have a modulus of elasticity between 1 MPa and 500 MPa, in some cases between 150 MPa and 350 MPa, in some cases about 250 MPa.

For instance, the material 74 of the element 72 may comprise a polymeric material. In this embodiment, the polymeric material is foam.

In some embodiments, the material 74 of the element 72 may comprise a thermoformable material to customize the element 72. For instance, the element 72 may be provided in a first shape, may be heated at a pre-determined temperature for a pre-determined period of time, e.g., at about 65° Celsius for about 3 minutes, may be then pressed upon the goalie's leg $16_x$ to provide the element 72 with a customized shape. For example, the thermoformable material may comprise thermoformable foam.

In some embodiments, the element 72 is custom-manufactured. For instance, a scan of the goalie's leg $16_x$, a listing of dimensions of the goalie's leg $16_x$, or any support transmitting dimensional data of the goalie's leg $16_x$ may be provided to the manufacturing facility and manufacturing may be customized by using, for instance, a pre-existing molding last corresponding to the shape of the goalie's leg $16_x$, a customized molding last, etc.

The goalie pad $10_x$ may be constructed in various other ways in other embodiments.

Figure 29:
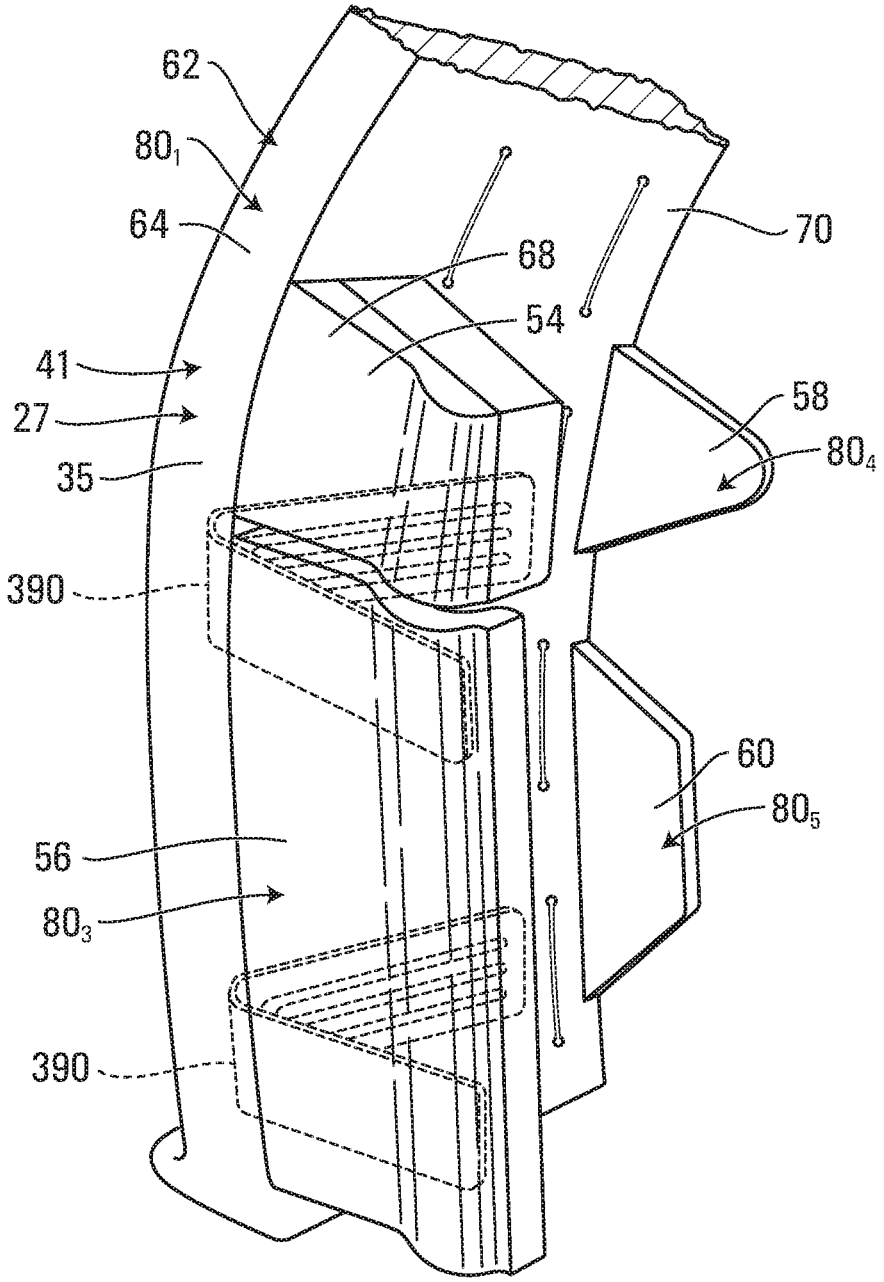

For example, in some embodiments, as shown in FIG. 29, the front pad member $80_1$ and the medial side calf pad member $80_3$ may be interconnected as discussed above in respect of the front pad member $80_1$ and the medial side knee pad member $80_2$ and may comprise a reinforcement 390 as discussed above in respect of the reinforcement 90.

Figure 30:
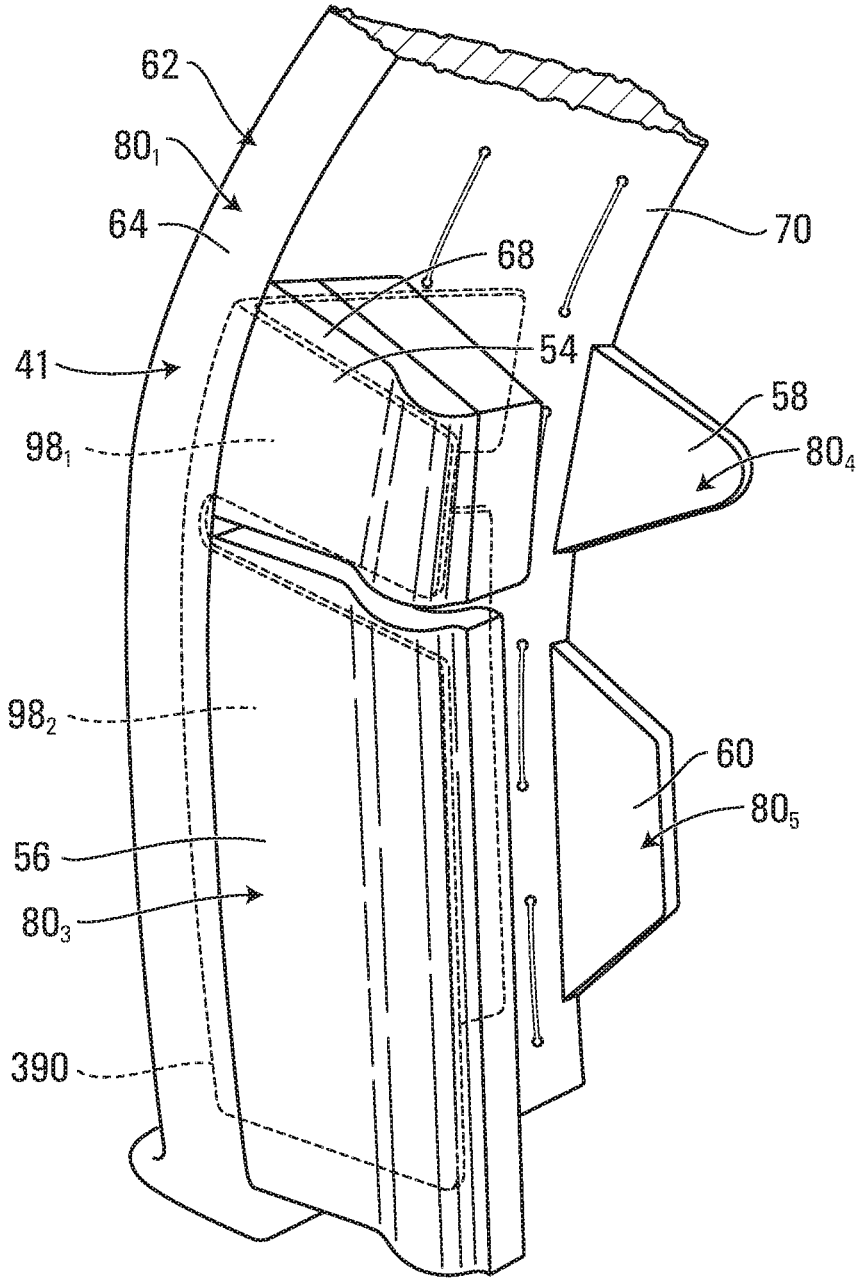
Figure 31:
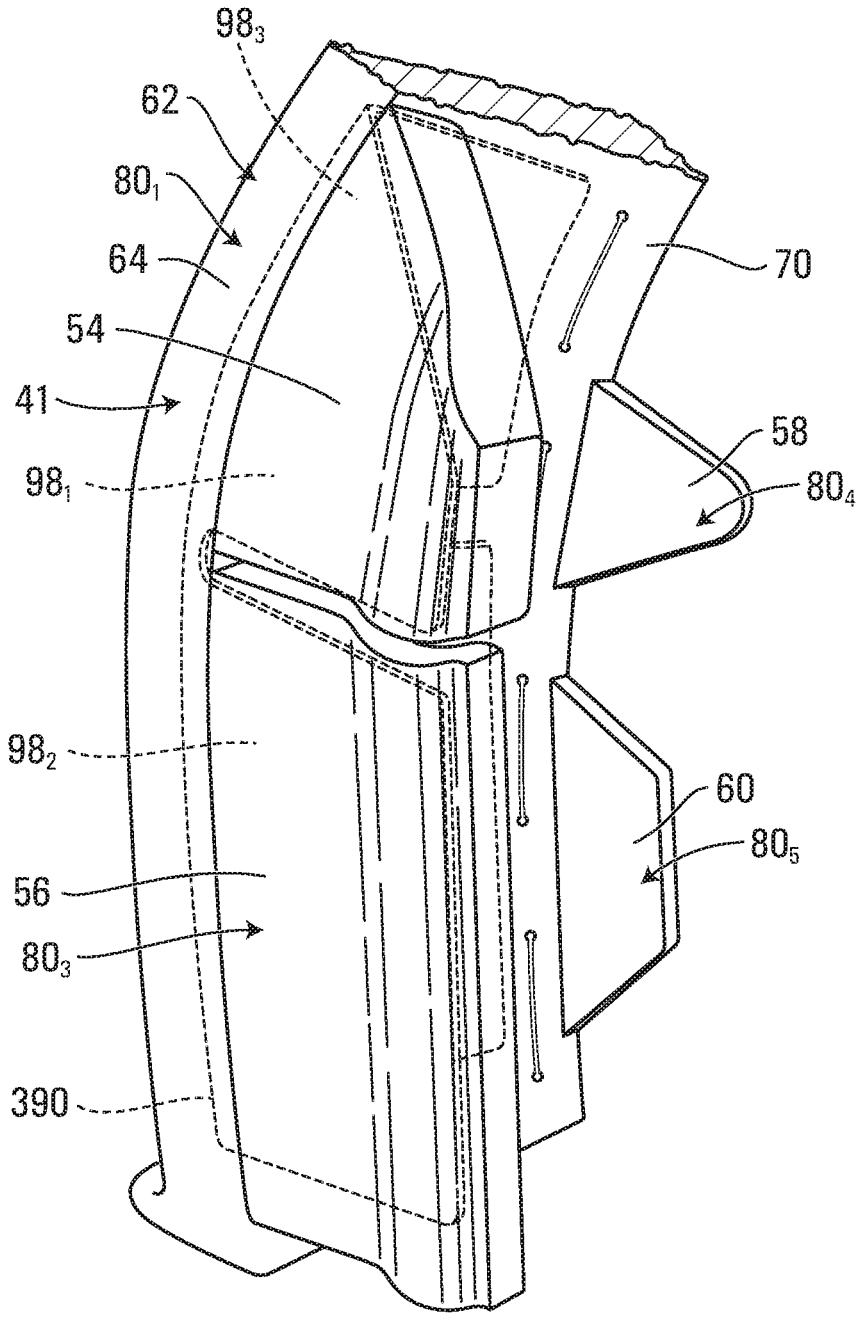

As another example, in some embodiments, as shown in FIGS. 30 and 31, the reinforcement 90 may extend over at least a majority (i.e., a majority or an entirety) of the medial side portion 27 of the goalie pad $10_x$. This may further enhance stability. For instance, in this embodiment, the reinforcement 90 comprises a medial side knee portion $98_1$ adjacent to the medial side knee pad member $80_2$ and a medial side calf portion $98_2$ adjacent to the medial side calf pad member $80_3$. The medial side knee portion $98_1$ and the medial side calf portion $98_2$ are interconnected (e.g., molded together or fastened to one another) such that they are a unitary one-piece structure. In this embodiment, the reinforcement 90 also comprises a medial upper leg portion $98_3$ disposed in the upper leg portion 30 of the goalie pad $10_x$ so that it extends upwardly from medial side knee portion $98_1$. In this case, the medial upper leg portion $98_3$, the medial side knee portion $98_1$, and the medial side calf portion $98_2$ are interconnected (e.g., molded together or fastened to one another) such that they are a unitary one-piece structure.

Figure 32:
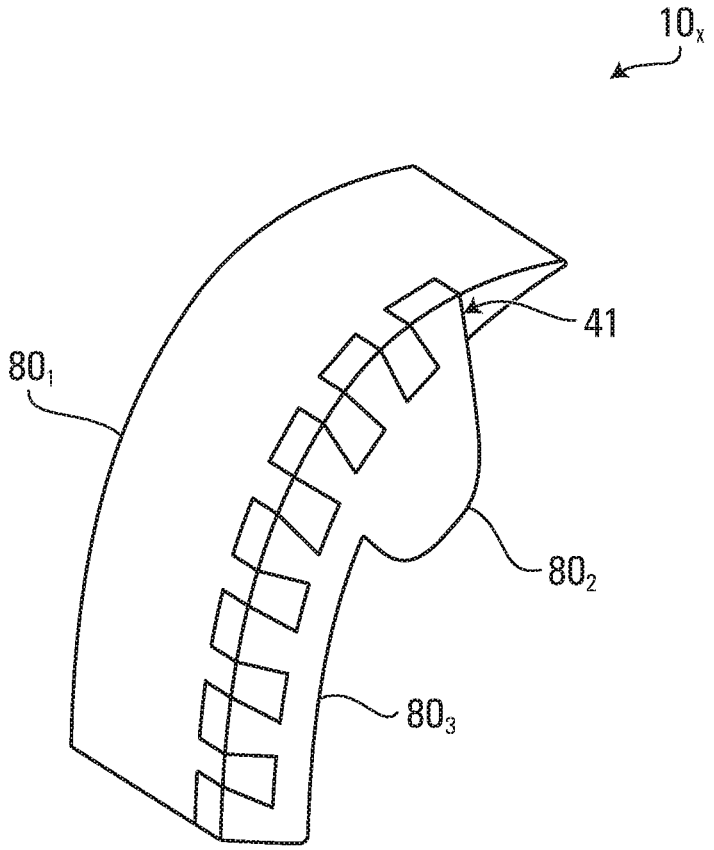
Figure 33:
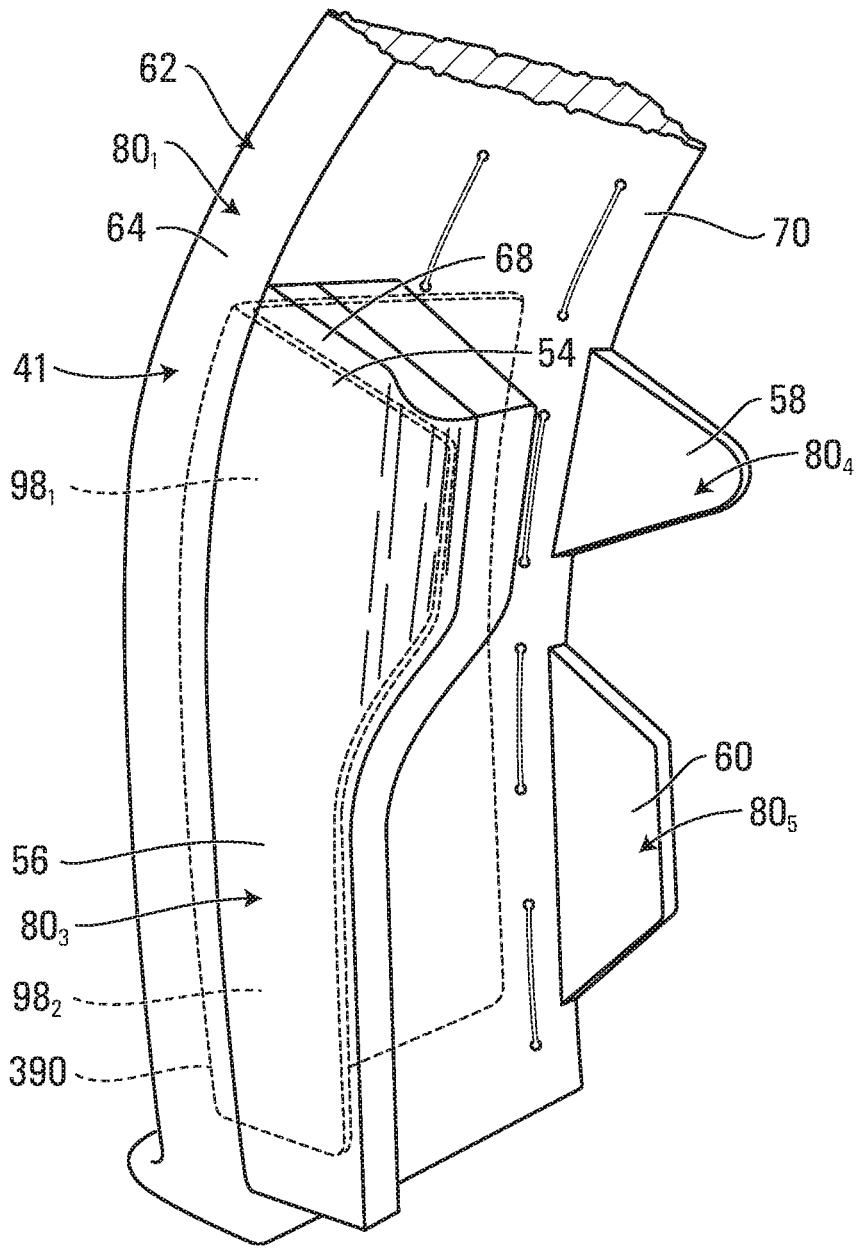

As another example, in some embodiments, as shown in FIGS. 32 and 33, the front pad member $\mathbf{80}_1$ and the medial side calf pad member $\mathbf{80}_3$ may be connected (e.g., by fastening) or integrally formed with the medial side knee pad member $\mathbf{80}_2$ and the medial side pad members $\mathbf{80}_2$, $\mathbf{80}_3$ may be interconnected as discussed above in respect of the front pad member $\mathbf{80}_1$ and the medial side knee pad member $\mathbf{80}_2$.

Also, in some embodiments, the lateral side knee pad member $\mathbf{80}_4$ and/or the lateral side calf pad member $\mathbf{80}_5$ may similarly be interconnected with the front pad member $\mathbf{80}_1$ and/or reinforced.

As another example, in other embodiments, the goalie pads $\mathbf{10}_1$, $\mathbf{10}_2$ may have any other suitable shape and/or be made of any other suitable material.

As another example, in some embodiments, the medial side knee extension 54 (e.g., the medial side knee pad member $\mathbf{80}_2$ and/or the medial side reinforcing member $\mathbf{92}_2$ of the reinforcement 90) may be configured to promote a center of gravity of the goalie being over the skates of the goalie when the goalie is in a base position, i.e., an athletic position. In other words, goalie pads usually add weight in front of goalies' legs and, to keep balance, goalies have to bring their center of gravity backwards, i.e. behind their skates when they are in their base position, which is not biomechanically optimal to react rapidly and precisely to the hockey game play.

Figure 34:
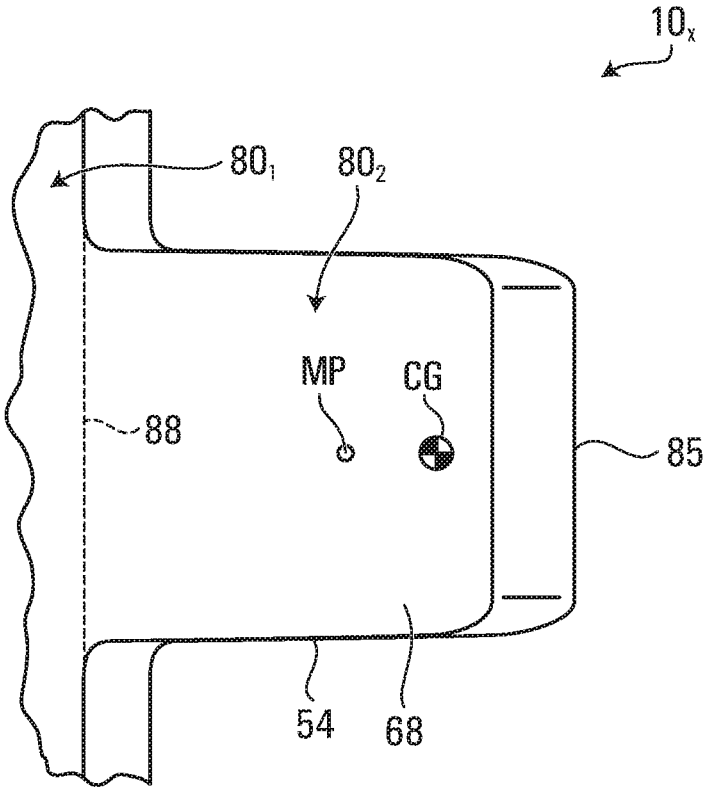

For instance, in some embodiments, as shown in FIG. 34, a center of gravity CG of the medial side knee extension 54 may be offset rearwardly relative to a midpoint MP of the medial side knee extension 54 in the thicknesswise direction of the goalie pad $\mathbf{10}_x$. The midpoint MP of the medial side knee extension 54 is located at half of a distance between a front 88 of the medial side knee extension 54 where the medial side knee extension 54 projects from the front portion 26 of the goalie pad $\mathbf{10}_x$ and a rear 85 of the medial side knee extension 54 farthest from the front portion 26 of the goalie pad $\mathbf{10}_x$. The center of gravity CG of the medial side knee extension 54 is thus located between the midpoint MP and the rear 85 of the medial side knee extension 54.

The center of gravity CG of the medial side knee extension 54 may be offset rearwardly relative to the midpoint MP of the medial side knee extension 54 in any suitable way. For instance, in various embodiments, there may be more and/or denser material (e.g., of the medial side knee pad member $\mathbf{80}_2$ and/or the medial side reinforcing member $\mathbf{92}_2$ of the reinforcement 90) between the midpoint MP and the rear 85 of the medial side knee extension 54 than between the midpoint MP and the front 88 of the medial side knee extension.

Figure 35:
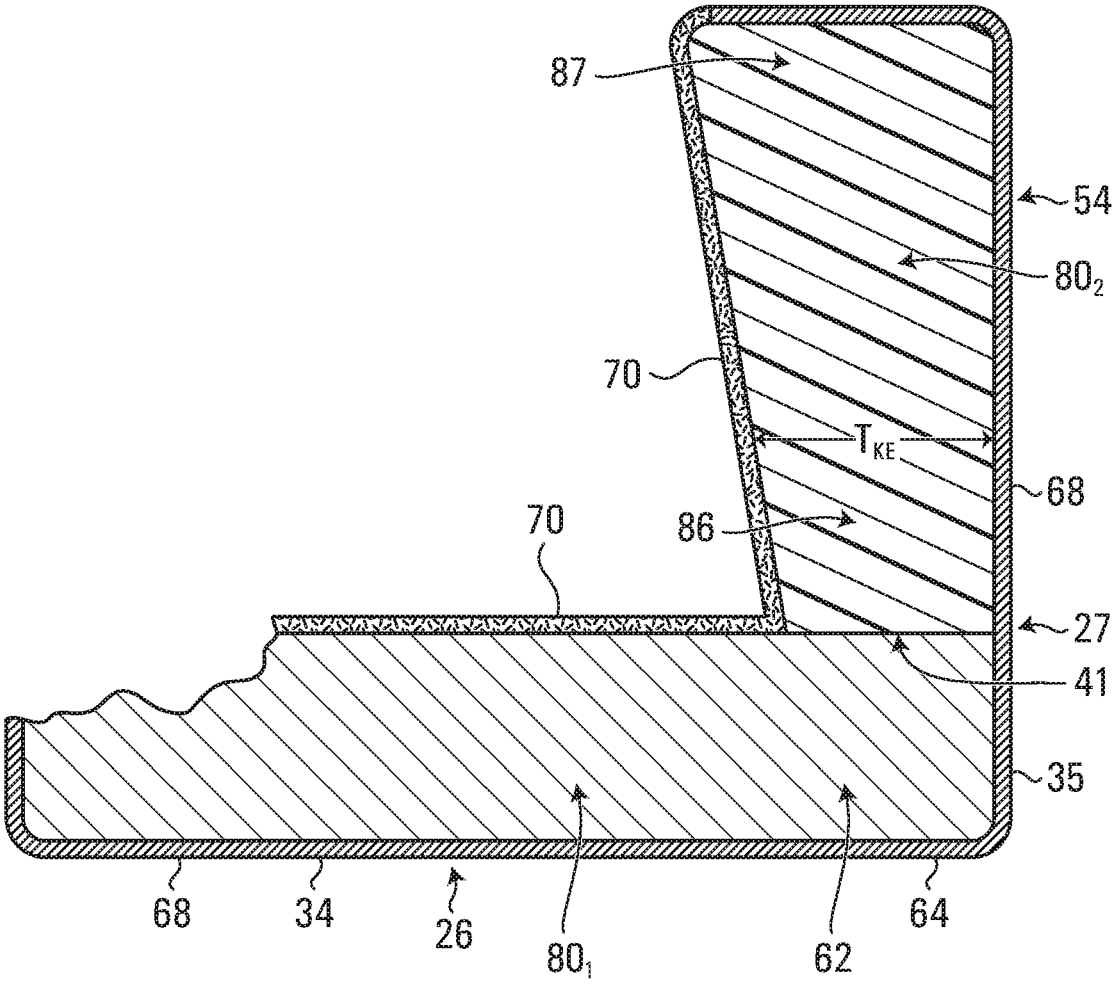
Figure 36:
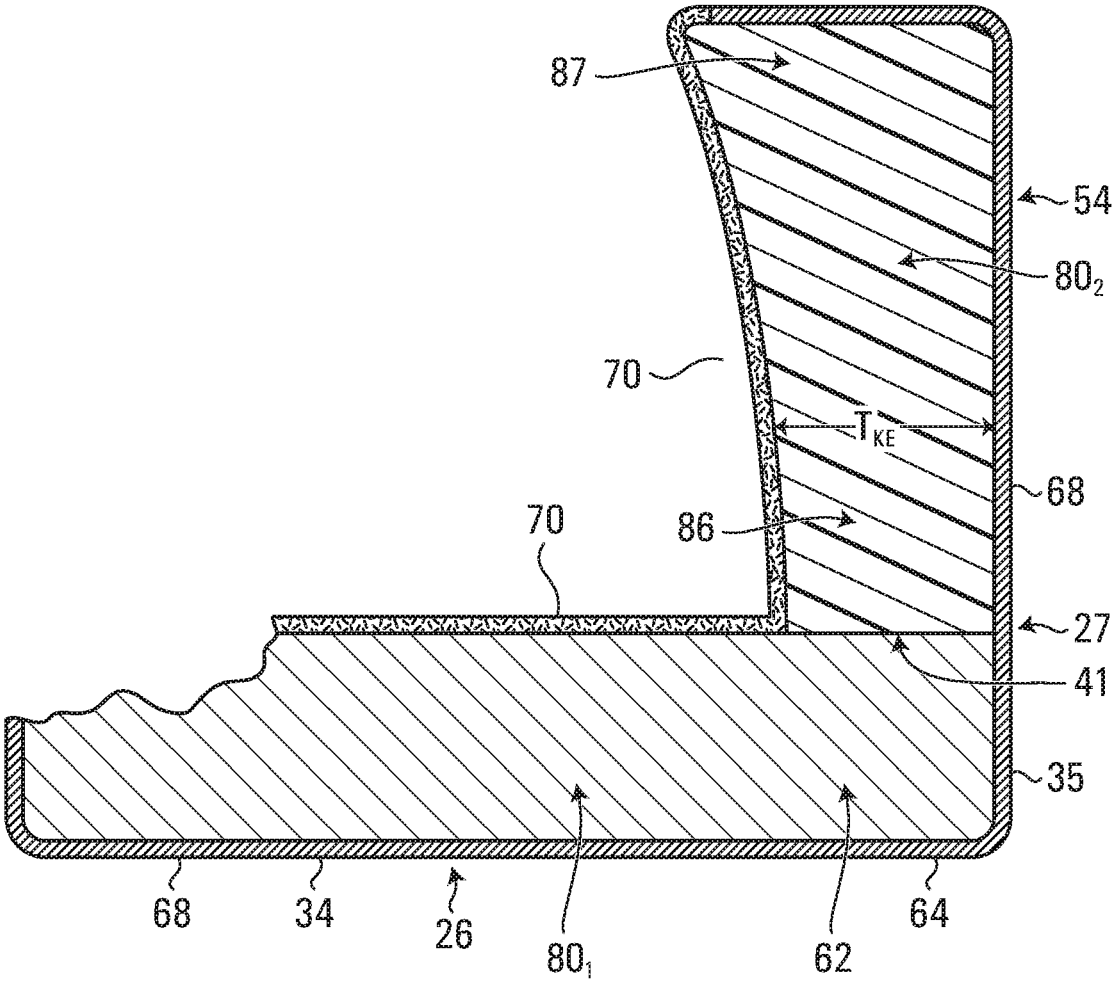
Figure 37:
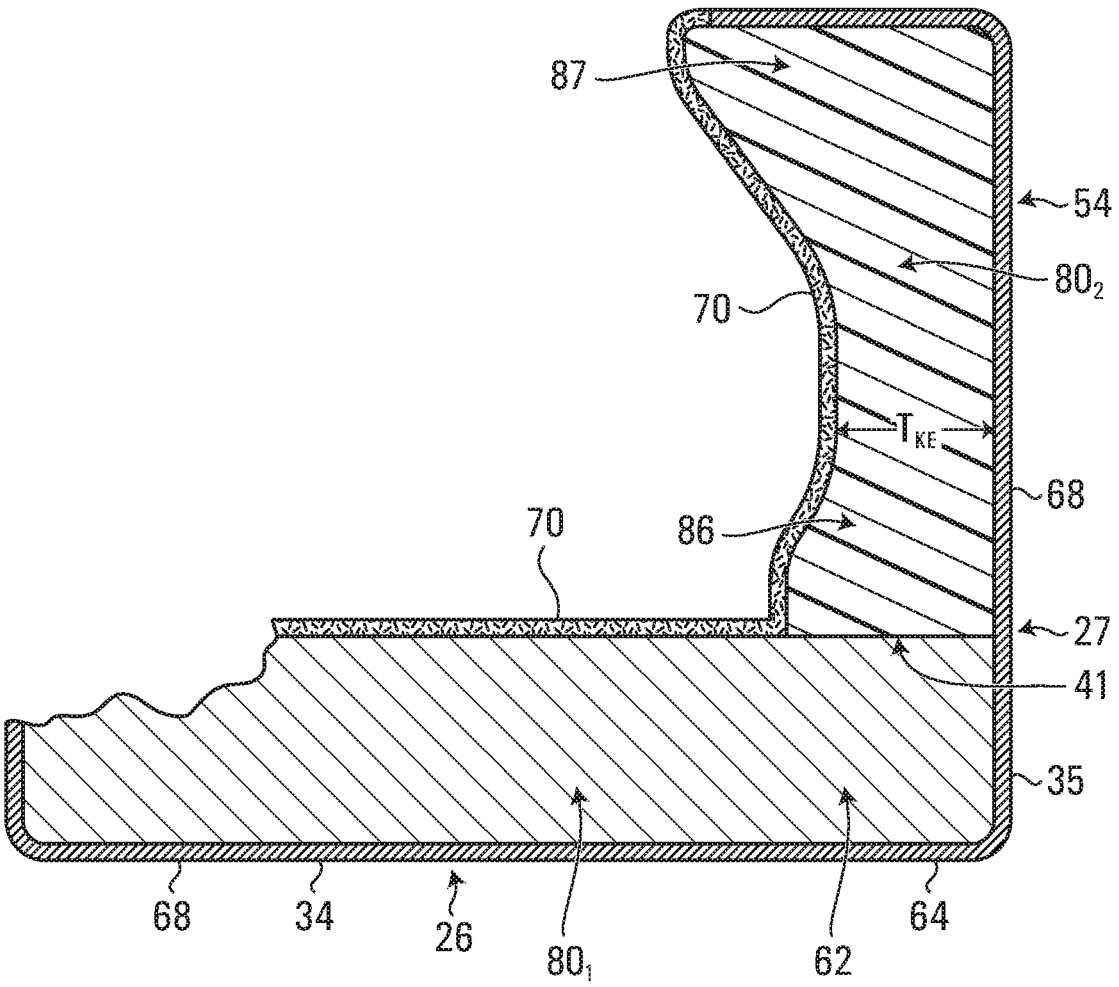

For example, in some embodiments, as shown in FIG. 35, the inner cover 70 of the medial side portion 27 extends inwardly, i.e., the thickness $T_{KE}$ of the medial side knee extension 54 varies along the length of the medial side knee extension 54 and is relatively greater in a back portion 87 of the medial side knee extension 54 than in a front portion 86 of the medial side knee extension 54. This may, for instance, move the center of gravity of the hockey goalkeeper leg pad $\mathbf{10}_x$ backwards and/or more efficiently engage the goalie's leg $\mathbf{16}_x$ in the hockey goalkeeper leg pad $\mathbf{10}_x$, and thus to keep balance the goalie may not be forced to moved his/her center of gravity backwards. In a similar example, as shown in FIG. 36, the thickness $T_{KE}$ of the medial side knee extension 54 varies along the length of the medial side knee extension 54 and the medial side knee extension 54 is cup-shaped. In yet another similar example, as shown in FIG. 37, the thickness $T_{KE}$ of the medial side knee extension 54 varies along the length of the medial side knee extension 54 to conform to the shape of the goalie's leg $\mathbf{16}_x$ and the medial side knee extension 54 is customized during and/or after manufacturing.

Similarly, in some examples, a thickness of the medial side knee pad member $\mathbf{80}_2$ may vary along the length of the medial side knee pad member $\mathbf{80}_2$, may be relatively greater in the back portion 87 of the medial side knee extension 54 than in the front portion 86 of the medial side knee extension 54, may be cup-shaped, and/or may be customized during and/or after manufacturing.

Figure 38:
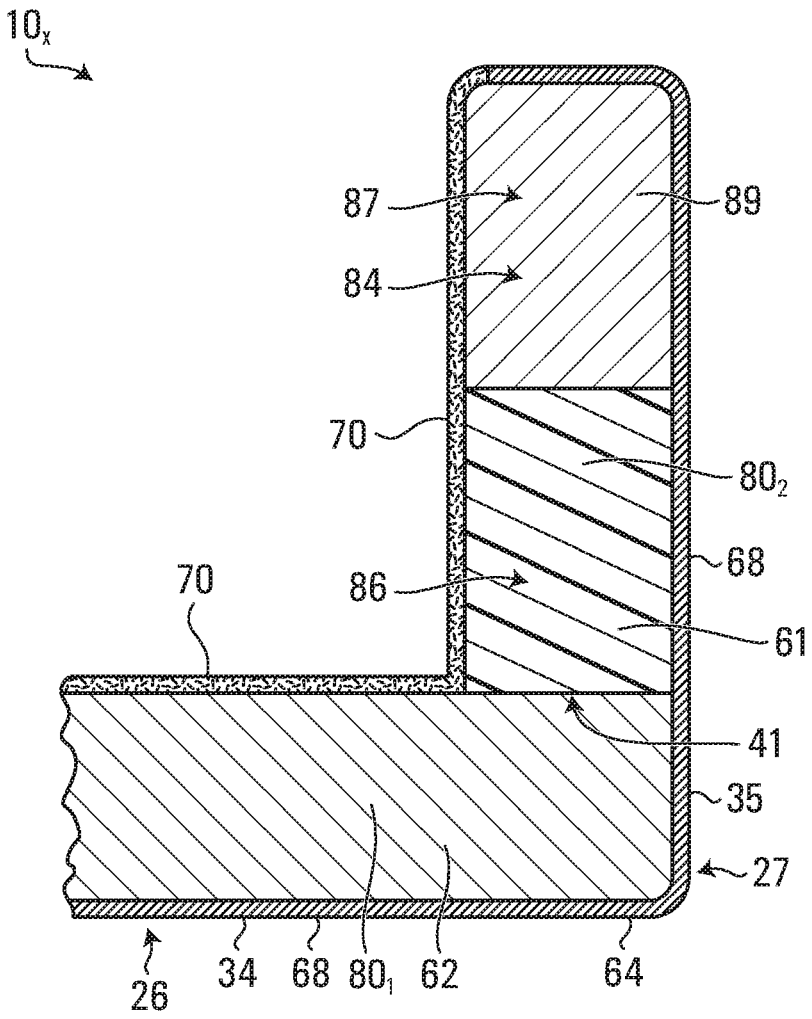

In some examples, as shown in FIG. 38, the medial side knee pad member $\mathbf{80}_2$ comprises a portion 84 comprising a material 89 having a greater density than the material 61 of the remainder of the medial side knee pad member $\mathbf{80}_2$. The portion 84 is closer to the back portion 87 than it is to the front portion 86, such as to move the center of gravity of the hockey goalkeeper leg pad $\mathbf{10}_x$ backwards thus to keep balance the goalie may not be forced to moved his/her center of gravity backwards.

Figure 39:
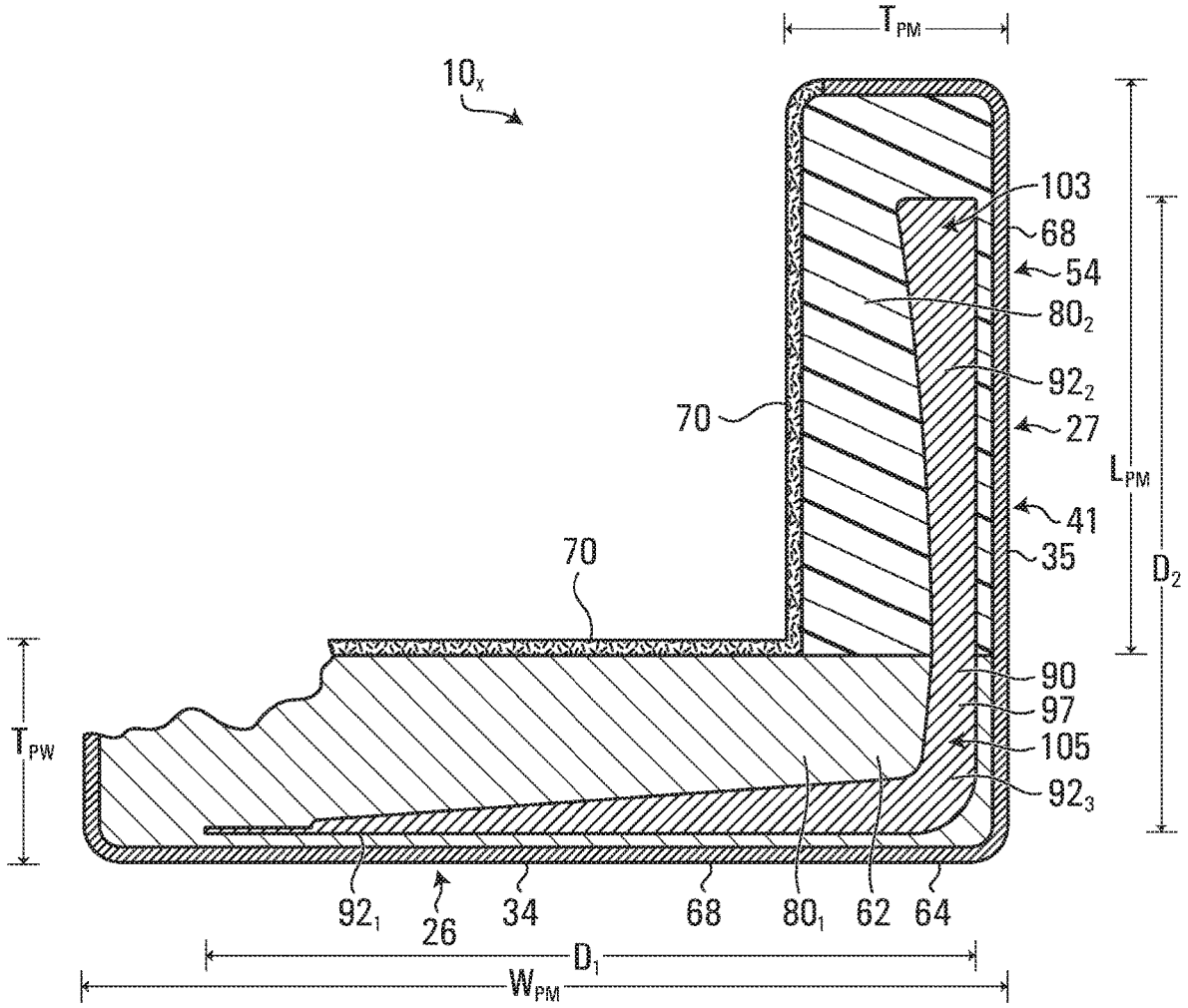
Figure 40:
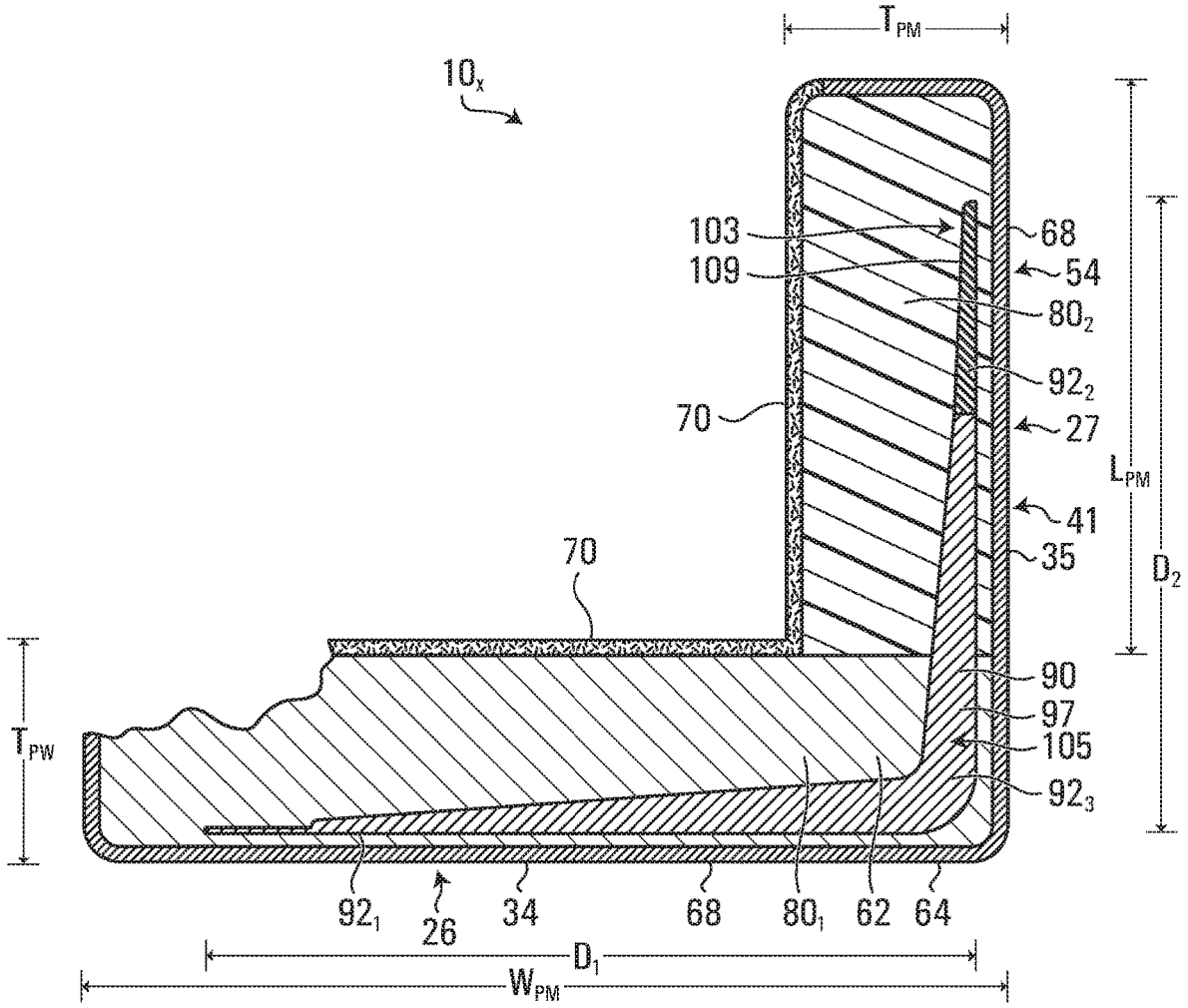

Similarly, in some embodiments, as shown in FIGS. 39 and 40, a thickness of the medial side reinforcing member $\mathbf{92}_2$ of the reinforcement 90 may vary along the length of the medial side reinforcing member $\mathbf{92}_2$, may be relatively greater in a back portion 103 of the medial side reinforcing member $\mathbf{92}_2$ than in front portion 105 of the medial side reinforcing member $\mathbf{92}_2$ and/or may be cup-shaped. In some embodiments, also, the back portion 103 of the medial side reinforcing member $\mathbf{92}_2$ of the reinforcement 90 may comprise a material 109 having a greater density than the density of the rigid material 97.

Although in embodiments considered above the goalie pads $\mathbf{10}_1$, $\mathbf{10}_2$ are designed for playing ice hockey, in other embodiments, hockey goalkeeper leg pads constructed using principles described herein in respect of the goalie pads $\mathbf{10}_1$, $\mathbf{10}_2$ can be hockey goalkeeper leg pads for playing roller hockey or another type of hockey (e.g., field or street hockey) on a dry playing surface (e.g., a polymeric, concrete, wooden, or turf playing surface or any other dry playing surface on which roller hockey or field or street hockey is played).

Certain additional elements that may be needed for operation of some embodiments have not been described or illustrated as they are assumed to be within the purview of those of ordinary skill in the art. Moreover, certain embodiments may be free of, may lack and/or may function without any element that is not specifically disclosed herein.

Any feature of any embodiment discussed herein may be combined with any feature of any other embodiment discussed herein in some examples of implementation.

In case of any discrepancy, inconsistency, or other difference between terms used herein and terms used in any document incorporated by reference herein, meanings of the terms used herein are to prevail and be used.

Although various embodiments and examples have been presented, this was for purposes of description, but should not be limiting. Various modifications and enhancements will become apparent to those of ordinary skill in the art.

The invention claimed is:

1. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising:

a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding;

wherein: the front pad member and the side pad member are interconnected; the hockey goalkeeper pad comprises a reinforcement disposed in the front portion and the side portion; the reinforcement comprises a rigid material; the front portion comprises a front reinforcing member of the reinforcement configured to be in front of the leg of the hockey goalkeeper when the hockey goalkeeper wears the hockey goalkeeper leg pad; the front reinforcing member is adjacent to and stiffer than the front pad member; the side portion comprises a side reinforcing member of the reinforcement; the side reinforcing member is adjacent to and stiffer than the side pad member; the front reinforcing member and the side reinforcing member are interconnected; and the reinforcement is L-shaped and comprises a first end and a second end respectively defined by the front reinforcing member and the side reinforcing member.

2. The hockey goalkeeper leg pad of claim 1, wherein the front pad member and the side pad member are unitary.

3. The hockey goalkeeper leg pad of claim 1, wherein the front pad member and the side pad member are contiguous.

4. The hockey goalkeeper leg pad of claim 1, wherein the front pad member and the side pad member extend from one another.

5. The hockey goalkeeper leg pad of claim 1, wherein the front pad member and the side pad member are mechanically interlocked with one another.

6. The hockey goalkeeper leg pad of claim 1, wherein the front pad member and the side pad member are fastened together.

7. The hockey goalkeeper leg pad of claim 6, wherein the front pad member and the side pad member are fastened together by an adhesive between the front pad member and the side pad member.

8. The hockey goalkeeper leg pad of claim 6, wherein the front pad member and the side pad member are fastened together by a mechanical fastener between the front pad member and the side pad member.

9. The hockey goalkeeper leg pad of claim 1, wherein the front pad member and the side pad member lie substantially perpendicularly to one another.

10. The hockey goalkeeper leg pad of claim 1, wherein the side pad member is thicker than the front pad member where the side portion projects rearwardly from the front portion.

11. The hockey goalkeeper leg pad of claim 1, comprising a covering that covers at least part of the padding, wherein the front pad member and the side pad member are connected to one another inside the covering.

12. The hockey goalkeeper leg pad of claim 11, wherein the front pad member and the side pad member are connected to one another independently of a connection of the covering and the padding.

13. The hockey goalkeeper leg pad of claim 11, wherein: the covering comprises an outer cover and an inner cover; and the padding is disposed between the outer cover and the inner cover.

14. The hockey goalkeeper leg pad of claim 13, wherein: the outer cover and the inner cover are fastened to one another; and the front pad member and the side pad member are connected to one another independently of fastening of the outer cover and the inner cover.

15. The hockey goalkeeper leg pad of claim 1, wherein the reinforcement comprises a bracket.

16. The hockey goalkeeper leg pad of claim 1, wherein the front reinforcing member and the side reinforcing member lie substantially perpendicularly to one another.

17. The hockey goalkeeper leg pad of claim 1, wherein the front reinforcing member and the side reinforcing member are integrally formed with one another.

18. The hockey goalkeeper leg pad of claim 1, wherein the front reinforcing member and the side reinforcing member are contiguous.

19. The hockey goalkeeper leg pad of claim 1, wherein the front reinforcing member and the side reinforcing member extend from one another.

20. The hockey goalkeeper leg pad of claim 1, wherein the front reinforcing member and the side reinforcing member are fastened together.

21. The hockey goalkeeper leg pad of claim 1, wherein a modulus of elasticity of the rigid material is at least 500 MPa.

22. The hockey goalkeeper leg pad of claim 1, wherein a modulus of elasticity of the rigid material is at least 1 500 MPa.

23. The hockey goalkeeper leg pad of claim 1, wherein a modulus of elasticity of the rigid material is at least 100 000 MPa.

24. The hockey goalkeeper leg pad of claim 1, wherein the rigid material comprises a polymeric material.

25. The hockey goalkeeper leg pad of claim 1, wherein the reinforcement comprises a rib extending from the front reinforcing member to the side reinforcing member.

26. The hockey goalkeeper leg pad of claim 1, wherein the reinforcement comprises a plurality of ribs extending from the front reinforcing member to the side reinforcing member.

27. The hockey goalkeeper leg pad of claim 1, wherein the side portion is a medial side portion, the side of the hockey goalkeeper's leg is a medial side of the hockey goalkeeper's leg, the side extension is a medial side extension, and the side pad member is a medial side pad member.

28. The hockey goalkeeper leg pad of claim 27, wherein the medial side portion includes a medial side knee part of the knee portion, the medial side extension is a medial side knee extension, the medial side pad member is a medial side knee pad member, and the reinforcement is disposed in the front portion and in the medial side knee part.

29. The hockey goalkeeper leg pad of claim 1, wherein: the side extension is a first side extension, the side pad member is a first side pad member; the side portion comprises a second side extension that projects rearwardly from the front portion, that comprises a second side pad member of the padding and that is spaced from the first side extension in a longitudinal direction of the hockey goalkeeper leg pad; and the front pad member and the second side pad member are interconnected.

30. The hockey goalkeeper leg pad of claim 29, wherein the side portion is a medial side portion, the side of the hockey goalkeeper's leg is a medial side of the hockey goalkeeper's leg, the first side extension is a medial side knee extension, the first side pad member is a medial side knee pad member, the second side extension is a medial side calf extension, and the second side pad member is a medial side calf pad member.

31. The hockey goalkeeper leg pad of claim 30, wherein: the reinforcement is a first reinforcement; the hockey goalkeeper leg pad comprises a second reinforcement disposed in the front portion and the side portion and spaced from the first reinforcement; the front portion comprises a front reinforcing member of the second reinforcement; the front reinforcing member of the second reinforcement is adjacent to and stiffer than the front pad member; the side portion comprises a side reinforcing member of the second reinforcement; the side reinforcing member of the second reinforcement is adjacent to and stiffer than the medial side calf pad member; and the front reinforcing member and the side reinforcing member of the second reinforcement are interconnected.

32. The hockey goalkeeper leg pad of claim 31, wherein the first reinforcement is spaced from the second reinforcement in the longitudinal direction of the hockey goalkeeper leg pad.

33. The hockey goalkeeper leg pad of claim 1, wherein: the side portion is a medial side portion; the side of the hockey goalkeeper's leg is a medial side of the hockey goalkeeper's leg; the side extension is a medial side extension; the side pad member is a medial side pad member; the hockey goalkeeper leg pad comprises a lateral side portion configured to overlie a lateral side of the hockey goalkeeper's leg and comprising a lateral side extension that projects rearwardly from the front portion and comprises a lateral side pad member of the padding; and the front pad member and the lateral side pad member are interconnected.

34. The hockey goalkeeper leg pad of claim 1, wherein the reinforcement is concealed from an exterior of the front portion of the hockey goalkeeper leg pad and of the side portion of the hockey goalkeeper leg pad.

35. The hockey goalkeeper leg pad of claim 1, wherein the reinforcement is located inside the hockey goalkeeper leg pad.

36. The hockey goalkeeper leg pad of claim 1, wherein: the front pad member and the side pad member comprise a foam; and the reinforcement contacts the foam.

37. The hockey goalkeeper leg pad of claim 1, wherein a rotational stiffness of a connection between the front pad member and the side pad member is at least 1000 N·mm per degree.

38. The hockey goalkeeper leg pad of claim 1, wherein the side extension comprises an outer surface configured to engage a playing surface and has a dynamical coefficient of friction with ice of no more than 0.7.

39. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising:

a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding;

wherein: the front pad member and the side pad member are connected to one another independently of a connection of a covering and the padding; the hockey goalkeeper leg pad comprises a reinforcement disposed in the front portion and the side portion; the reinforcement comprises a rigid material; the front portion comprises a front reinforcing member of the reinforcement;

the front reinforcing member is adjacent to and stiffer than the front pad member; the side portion comprises a side reinforcing member of the reinforcement; the side reinforcing member is adjacent to and stiffer than the side pad member; the front reinforcing member and the side reinforcing member are interconnected; the reinforcement is L-shaped and comprises a first end and a second end respectively defined by the front reinforcing member and the side reinforcing member; the side extension is a first side extension, the side pad member is a first side pad member; the side portion comprises a second side extension that projects rearwardly from the front portion, that comprises a second side pad member of the padding and that is spaced from the first side extension in a longitudinal direction of the hockey goalkeeper leg pad; the front pad member and the second side pad member are interconnected; the side portion is a medial side portion, the side of the hockey goalkeeper's leg is a medial side of the hockey goalkeeper's leg, the first side extension is a medial side knee extension, the first side pad member is a medial side knee pad member, the second side extension is a medial side calf extension, and the second side pad member is a medial side calf pad member; the reinforcement is a first reinforcement; the hockey goalkeeper leg pad comprises a second reinforcement disposed in the front portion and the side portion and spaced from the first reinforcement; the front portion comprises a front reinforcing member of the second reinforcement; the front reinforcing member of the second reinforcement is adjacent to and stiffer than the front pad member; the side portion comprises a side reinforcing member of the second reinforcement; the side reinforcing member of the second reinforcement is adjacent to and stiffer than the medial side calf pad member; and the front reinforcing member and the side reinforcing member of the second reinforcement are interconnected.

40. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising a covering that covers at least part of the padding, the hockey goalkeeper leg pad comprising:

a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding;

wherein: the front pad member and the side pad member are connected to one another inside the covering; the hockey goalkeeper leg pad comprises a reinforcement disposed in the front portion and the side portion; the reinforcement comprises a rigid material; the front portion comprises a front reinforcing member of the reinforcement configured to be in front of the leg of the hockey goalkeeper when the hockey goalkeeper wears the hockey goalkeeper leg pad; the front reinforcing member is adjacent to and stiffer than the front pad member; the side portion comprises a side reinforcing member of the reinforcement; the side reinforcing member is adjacent to and stiffer than the side pad member; the front reinforcing member and the side reinforcing member are interconnected; and the reinforcement is L-shaped and comprises a first end and a second end respectively defined by the front reinforcing member and the side reinforcing member.

41. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising:

a front portion configured to overlie a front of the hockey goalkeeper's leg and comprising a front pad member of the padding; and a side portion configured to overlie a side of the hockey goalkeeper's leg and comprising a side extension that projects rearwardly from the front portion and comprises a side pad member of the padding;

wherein: the hockey goalkeeper leg pad comprises a reinforcement located inside the hockey goalkeeper leg pad, disposed in the front portion and the side portion, and comprising a rigid material; the front portion comprises a front reinforcing member of the reinforcement configured to be in front of the leg of the hockey goalkeeper when the hockey goalkeeper wears the hockey goalkeeper leg pad; the front reinforcing member is adjacent to and stiffer than the front pad member; the side portion comprises a side reinforcing member of the reinforcement; the side reinforcing member is adjacent to and stiffer than the side pad member; the front reinforcing member and the side reinforcing member are interconnected; and the reinforcement is L-shaped and comprises a first end and a second end respectively defined by the front reinforcing member and the side reinforcing member.

42. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising:

a front portion configured to overlie a front of the hockey goalkeeper's leg and comprising a front pad member of the padding;

a medial side portion configured to overlie a medial side of the hockey goalkeeper's leg and comprising:

a medial side knee extension that projects rearwardly from the front portion and comprises a medial side knee pad member of the padding, the medial side knee extension being configured to engage a playing surface when the knee of the hockey goalkeeper is pressed against the playing surface; and a medial side calf extension that projects rearwardly from the front portion and comprises a medial side calf pad member of the padding;

wherein: the medial side calf extension is configured to engage the playing surface and bear loading from the lower leg region of the hockey goalkeeper when the medial side knee extension engages the playing surface; the front portion and the medial side calf extension are interconnected; the hockey goalkeeper pad comprises a reinforcement disposed in the front portion and the medial side calf extension; the reinforcement comprises a rigid material; the front portion comprises a front reinforcing member of the reinforcement configured to be in front of the leg of the hockey goalkeeper when the hockey goalkeeper wears the hockey goalkeeper leg pad; the front reinforcing member is adjacent to and stiffer than the front pad member; the side portion comprises a side reinforcing member of the reinforcement; the side reinforcing member is adjacent to and stiffer than the medial side calf extension; the front reinforcing member and the side reinforcing member are interconnected; and the reinforcement is L-shaped and comprises a first end and a second end respectively defined by the front reinforcing member and the side reinforcing member.

43. A hockey goalkeeper leg pad wearable on a leg of a hockey goalkeeper to protect the leg, the hockey goalkeeper leg pad comprising an upper leg portion, a knee portion, a lower leg portion, and a foot portion respectively configured to protect an upper leg region, a knee, a lower leg region, and a foot of the hockey goalkeeper, the hockey goalkeeper leg pad comprising padding disposed in the upper leg portion, the knee portion, the lower leg portion, and the foot portion, the hockey goalkeeper leg pad comprising:

a front portion configured to overlie a front of the hockey goalkeeper's leg and comprising a front pad member of the padding;

a side portion configured to overlie a side of the hockey goalkeeper's leg and comprising a side extension that projects rearwardly from the front portion and comprises a side pad member of the padding;

wherein: the front pad member and the side pad member are interconnected; the hockey goalkeeper pad comprises a reinforcement disposed in the front portion and the side portion; the reinforcement comprises a rigid material; the front portion comprises a front reinforcing member of the reinforcement; the front reinforcing member is adjacent to and stiffer than the front pad member; the side portion comprises a side reinforcing member of the reinforcement; the side reinforcing member is adjacent to and stiffer than the side pad member; the front reinforcing member and the side reinforcing member are interconnected; and the reinforcement is configured to cause the side portion to be rotatable relative to the front portion over a range of motion comprising a position of the side portion relative to the front portion in which a resistance of the side portion to rotate outwardly is different from a resistance of the side portion to rotate inwardly.

* * * * *